US011442394B2

(12) United States Patent
Miyase et al.

(10) Patent No.: US 11,442,394 B2
(45) Date of Patent: Sep. 13, 2022

(54) IMAGE RECORDING APPARATUS

(71) Applicant: Brother Kogyo Kabushiki Kaisha, Nagoya (JP)

(72) Inventors: Satoshi Miyase, Nagoya (JP); Yoshinori Osakabe, Seto (JP); Tsuyoshi Kuwayama, Kasugai (JP); Yasuo Ono, Nagoya (JP); Yuto Chiba, Nagoya (JP); Jun Morikawa, Nagoya (JP); Haruka Azechi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/364,933

(22) Filed: Jul. 1, 2021

(65) Prior Publication Data

US 2022/0019167 A1 Jan. 20, 2022

(30) Foreign Application Priority Data

Jul. 15, 2020 (JP) ..... JP2020-121676

(51) Int. Cl.
*G03G 15/00* (2006.01)

(52) U.S. Cl.
CPC ..... *G03G 15/70* (2013.01)

(58) Field of Classification Search
CPC ..... G03G 15/70
See application file for complete search history.

(56) References Cited

U.S. PATENT DOCUMENTS 7,756,428 B2 * 7/2010 Anderson ..... G03G 15/6529 399/16
2005/0099438 A1 * 5/2005 Lester ..... B41J 13/0009 347/4
2006/0039727 A1 * 2/2006 Lofthus ..... G03G 15/238 399/381
2009/0194927 A1 * 8/2009 Mandel ..... B65H 29/68 270/58.01
2017/0090833 A1 * 3/2017 Kawano ..... G06F 3/1224
2021/0300095 A1 * 9/2021 Miyase ..... B41J 29/13

FOREIGN PATENT DOCUMENTS

JP H08-337011 A 12/1996

* cited by examiner

*Primary Examiner* — David H Banh
(74) *Attorney, Agent, or Firm* — Burr & Brown, PLLC

(57) ABSTRACT

An image forming apparatus includes a casing having a front end and a rear end, a first tray, a first print engine, a second tray, a second print engine and a controller. The controller configured to perform: receiving first image data representing the first image and second image data representing the second image; executing a first process including a first conveying process and a first recording process; executing a second process including a second conveying process and a second recording process; determining whether an error has occurred in the second process; and in a case where the error has occurred in the second process, stopping the second process while continuing the first process.

11 Claims, 13 Drawing Sheets

IMAGE RECORDING APPARATUS

CROSS-REFERENCE TO RELATED APPLICATION

This application claims priority from Japanese Patent Application No. 2020-121676 filed on Jul. 15, 2020, the content of which is incorporated herein by reference in its entirety.

TECHNICAL FIELD

Aspects of the disclosure relate to an image recording apparatus.

BACKGROUND

A known image recording apparatus includes a first print engine, a second print engine, a first tray and a second tray. A sheet in the first tray is conveyed to the first print engine along a first path. A sheet in the second tray is conveyed to the second print engine along a second path. Each of the first print engine and the second print engine is configured to execute a recording process for recording an image on a conveyed sheet.

SUMMARY

The sheet may be jammed in either of the first path or the second path, thereby causing corresponding print engine to stop the recording process therein.

Aspects of the disclosure provide an image recording apparatus configured to continue the recording process therein.

In one or more aspects of the disclosure, an image forming apparatus includes a casing having a front end and a rear end, a first tray configured to accommodate a first recording medium, a first print engine configured to record a first image on the first recording medium, a second tray configured to accommodate a second recording medium, a second print engine configured to record a second image on the second recording medium, and a controller. The controller is configured to perform: receiving image data, the image data including first image data representing the first image and second image data representing the second image; executing a first process including a first conveying process and a first recording process, the first conveying process being for conveying the first recording medium from the first tray toward the first print engine along a first path, the first recording process being for recording the first image on the first recording medium by the first print engine; executing a second process including a second conveying process and a second recording process, the second conveying process being for conveying the second recording medium from the second tray toward the second print engine along a second path, the second recording process being for recording the second image on the second recording medium by the second print engine, the second path being located between the first path and the rear end of the casing; determining whether an error has occurred in the second process; and in a case where the error has occurred in the second process, stopping the second process while continuing the first process.

In one or more aspects of the disclosure, an image forming apparatus includes a casing having a front end and a rear end, a first tray configured to accommodate a first recording medium, a first print engine configured to record an image on the first recording medium, a second tray configured to accommodate a second recording medium, a second print engine configured to record an image on the second recording medium, and a controller. The controller is configured to perform: receiving image data; executing a second process without executing a first process, wherein the first process includes a first conveying process and a first recording process, the first conveying process being for conveying the first recording medium from the first tray toward the first print engine along a first path, the first recording process being for recording the image on the first recording medium, and wherein the second process includes a second conveying process and a second recording process, the second conveying process being for conveying the second recording medium from the second tray toward the second print engine along a second path, the second recording process being for recording the image on the second recording medium, the second path being located between the first path and the rear end of the casing; determining whether an error has occurred in the second process; and in a case where the error has occurred in the second process: stopping the second process; and executing the first process such that the first recording process causing the first print engine to record the image on the first recording medium.

DETAILED DESCRIPTION

Figure 1A:
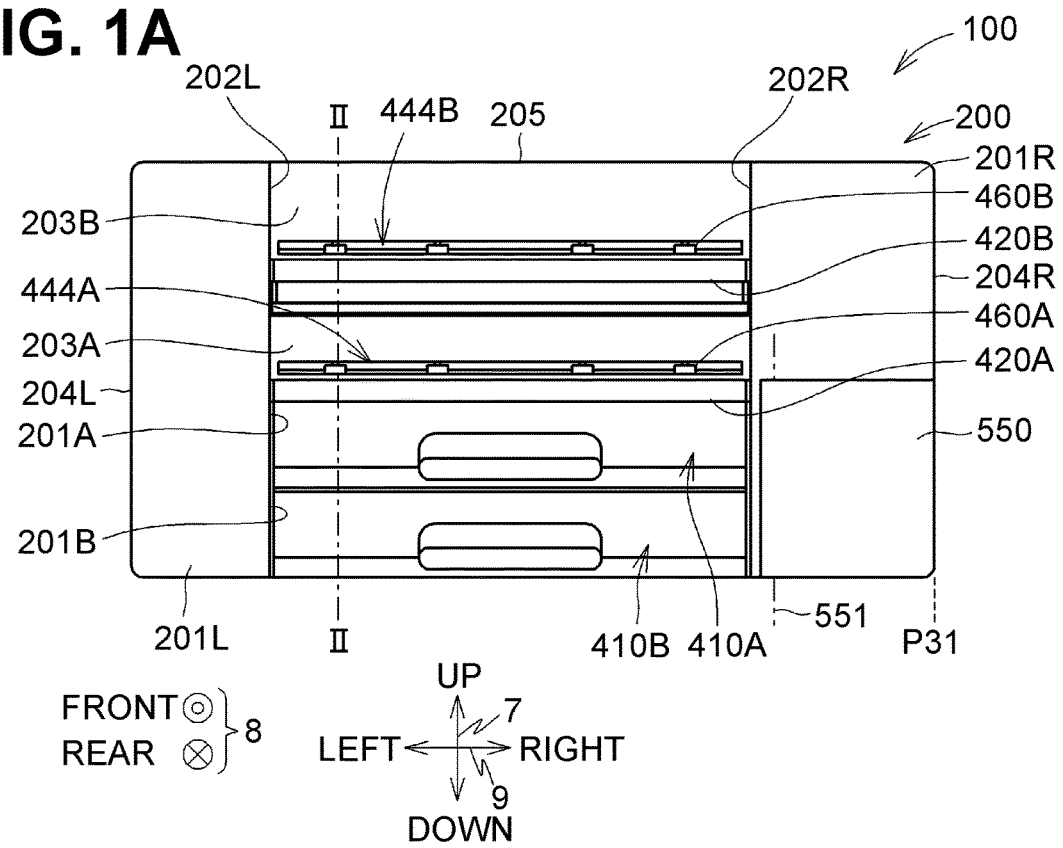
FIG. 1A is a front view of a printer 100.

Hereinafter, an illustrative embodiment will be described with reference to the accompanying drawings. Hereinafter, an up-down direction 7 may be defined with reference to a state in which the printer 100 is intended to be used as illustrated in FIG. 1. A front-rear direction 8 may be defined with front surfaces 201L and 201R as front side. A left-right direction 9 may be defined when viewed from the front surfaces 201L and 201R. The up-down direction 7, the front-rear direction 8, and the left-right direction 9 are orthogonal to each other.

General Configuration of Printer

The printer 100 includes a first printing mechanism and a second printing mechanism. The second printing mechanism is located between the first printing mechanism and the casing 200. As illustrated in FIG. 2, the first printing mechanism includes a supplying tray 410A, a discharging tray 420A, a feeding mechanism 430A, a conveying path 440A, a pair of conveying rollers 450A, a pair of discharging rollers 460A, a platen 470A, and a recording head 480A. The second printing mechanism includes a supplying tray 410B, a discharging tray 420B, a feeding mechanism 430B, a conveying path 440B, a pair of conveying rollers 450B, a pair of discharging rollers 460B, a platen 470B, and a recording head 480B. As illustrated in FIGS. 1 and 2, the printer 100 includes an inner guide 510, an outer guide 520, an inner path cover 530, an outer path cover 540, and a cartridge cover 550. The printer 100 is an example of an "image recording apparatus".

Figure 4:
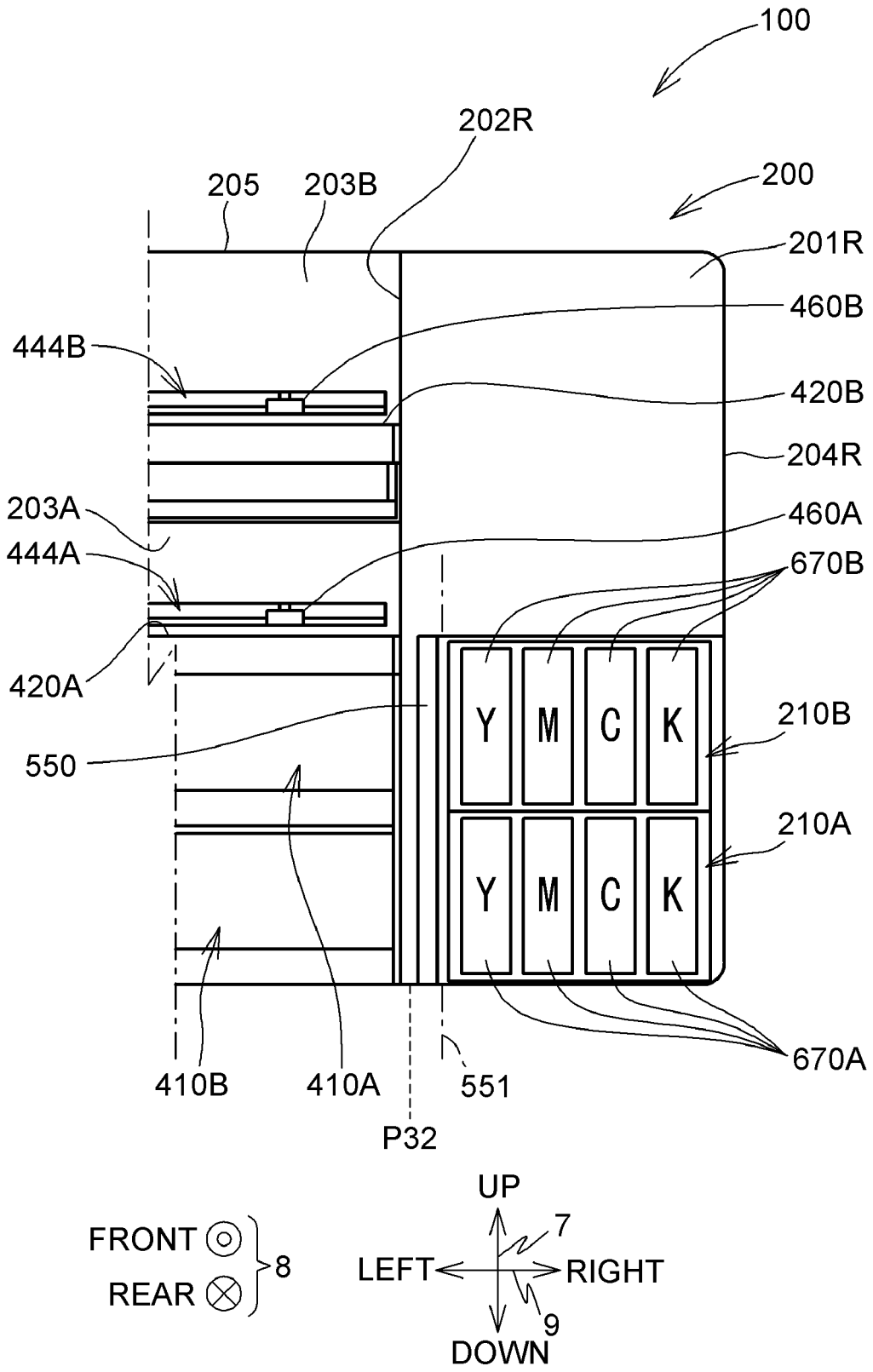
FIG. 4 is a schematic diagram illustrating cartridges 670A and 670B accommodated in the printer 100.

As illustrated in FIG. 4, the first printing mechanism includes a cartridge 670A. The second printing mechanism includes a cartridge 670B.

Figure 5:
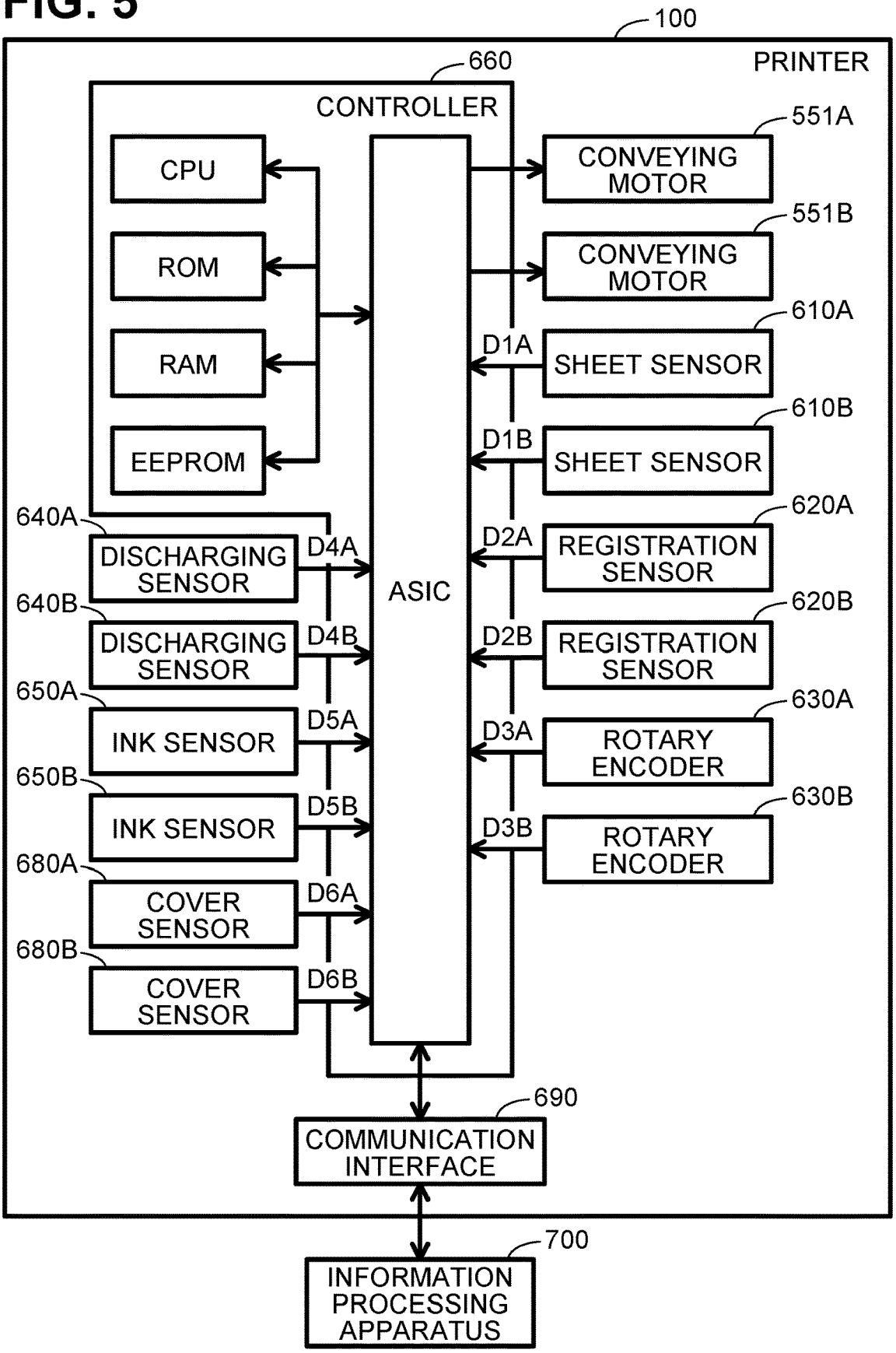
FIG. 5 is block diagram illustrating an electrical configuration of the printer 100.

As illustrated in FIG. 5, the first printing mechanism includes a conveying motor 551A, a sheet sensor 610A, a registration sensor 620A, a rotary encoder 630A, a discharging sensor 640A, an ink sensor 650A, and a cover sensor 680A. The second printing mechanism includes a conveying motor 551B, a sheet sensor 610B, a registration sensor 620B, a rotary encoder 630B, a discharging sensor 640B, an ink sensor 650B, and a cover sensor 680B. The printer 100 includes a controller 660 and a communication interface 690.

Casing 200

Figure 2:
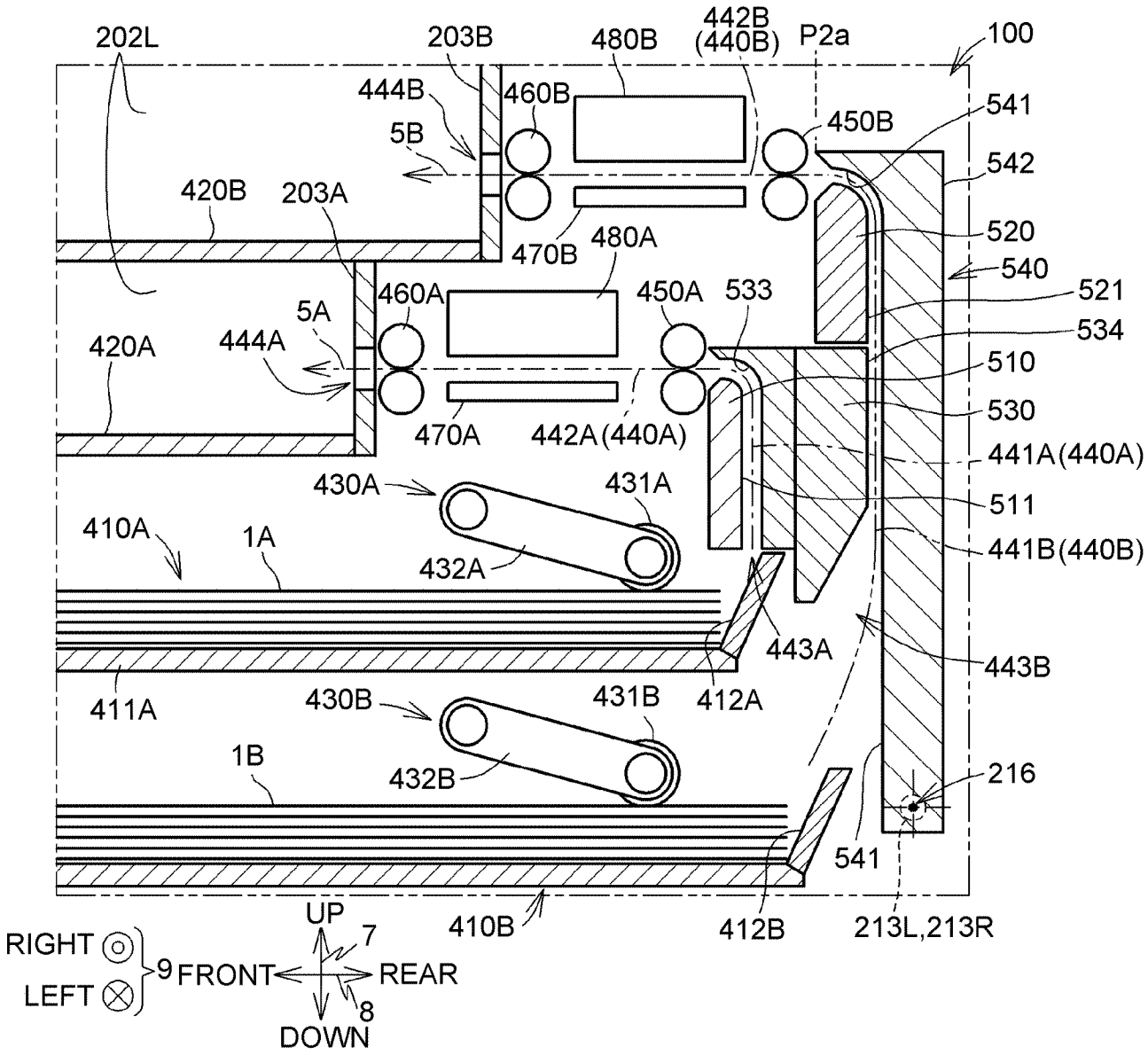
FIG. 2 is a partial cross-sectional view of the printer 100 taken along a dashed-dotted line II-Il in FIG. 1A while an outer path cover 540 is at a closed position P2A.

As illustrated in FIG. 1A, a casing 200 is an exterior body having a substantially rectangular parallelepiped shape. The casing 200 partitions an internal space thereof from an external space. The casing 200 is supported by various frames in the casing 200.

As illustrated in FIG. 1A, the casing 200 includes front surfaces 201L and 201R, inner surfaces 202L and 202R, back surfaces 203A and 203B, outer surfaces 204L and 204R, and an upper surface 205.

Each of the front surfaces 201L and 201R has a substantially rectangular shape when viewed from the front side. The front surfaces 201L and 201R are arranged in the left-right direction 9. The first printing mechanism includes an opening 201A located between the front surfaces 201L and 201R. The second printing mechanism includes an opening 201B located between the front surfaces 201L and 201R, and below the opening 201A.

The inner surface 202L extends rearward from a right end of the front surface 201L. The inner surface 202R extends rearward from a left end of the front surface 201R.

The first printing mechanism includes a back surface 203A that connects a rear end of the inner surface 202L and a rear end of the inner surface 202R. The back surface 203A has a discharging port 444A extending in the left-right direction 9 adjacent to its lower end. The second printing mechanism includes a back surface 203B that connects the rear end of the inner surface 202L and the rear end of the inner surface 202R, and is located above the back surface 203A. The back surface 203B has a discharging port 444B extending in the left-right direction 9 adjacent to its lower end.

Figure 1B:
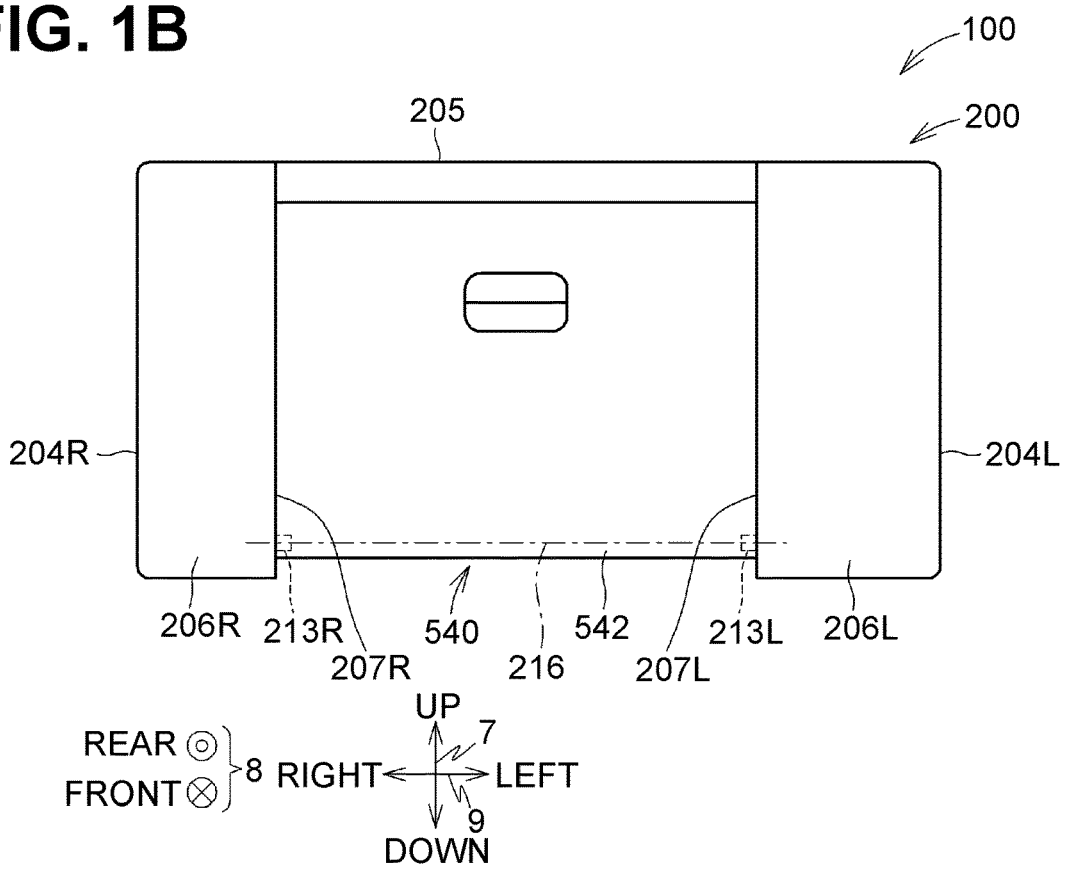
FIG. 1B is a rear view of the printer 100.

As illustrated in FIG. 1B, the casing 200 includes rear surfaces 206L and 206R, and inner side surfaces 207L and 207R.

Each of the rear surfaces 206L and 206R has a substantially rectangular shape when viewed from the rear side. The rear surface 206L and the rear surface 206R are arranged in the left-right direction 9. The rear surface 206L is located at left side of the casing 200. The rear surface 206R is located at right side of the casing 200.

The inner side surface 207L extends frontward from a right end of the rear surface 206L. The inner side surface 207R extends frontward from a left end of the rear surface 206R.

Supplying Trays 410A and 410B

As illustrated in FIG. 2, the supplying trays 410A and 410B have a box-shape that is thin in the up-down direction 7. The supplying tray 410A is configured to accommodate sheets 1A. The supplying tray 410A is inserted through the opening 201A, and located at its mounting position in the casing 200. The supplying tray 410B is configured to accommodate sheets 1B. The supplying tray 410B is inserted through the opening 201B, and located at its mounting position in the casing 200. Each of the sheets 1A and 1B is a paper or an OHP sheet.

The supplying tray 410A is an example of a "first tray". The supplying tray 410B is an example of a "second tray". The sheet 1A is an example of a "first recording medium". The sheet 1B is an example of a "second recording medium".

Discharging Trays 420A and 420B

The discharging tray 420A is configured to support the sheet 1A discharged from the discharging port 444A. As illustrated in FIG. 1A, the discharging tray 420A is located between the inner surfaces 202L and 202R. As illustrated in FIG. 2, the discharging tray 420A extends forward from below the discharging port 444A. The discharging tray 420B is configured to support the sheet 1B discharged from the discharging port 444B. As illustrated in FIG. 1A, the discharging tray 420B is located between the inner surfaces 202L and 202R. As illustrated in FIG. 2, the discharging tray 420B extends forward from below the discharging port 444B.

Feeding Mechanisms 430A and 430B

As illustrated in FIG. 2, the feeding mechanism 430A includes a feeding roller 431A, a feeding arm 432A, and a conveying motor 551A. The feeding arm 432A includes a drive transmission mechanism that is configured to transmit a driving force of a conveying motor 551A to the feeding roller 431A. This driving force may cause the feeding roller 431A to rotate, resulting in feeding the sheet 1A in the supplying tray 410A rearward. The sheet 1A conveyed rearward is then guided rearward and upward toward the conveying path 440A by the guide surface 412A that is located at a rear end of the supplying tray 410A.

As illustrated in FIG. 2, the feeding mechanism 430B includes a feeding roller 431B, a feeding arm 432B, and a conveying motor 551B. The feeding arm 432B includes a drive transmission mechanism that is configured to transmit a driving force of a conveying motor 551B to the feeding roller 431B. This driving force may cause the feeding roller 431B to rotate, resulting in feeding the sheet 1B in the supplying tray 410B rearward. The sheet 1B conveyed rearward is then guided rearward and upward toward the conveying path 440B by the guide surface 412B that is located at a rear end of the supplying tray 410B.

Conveying Paths 440A and 440B

As illustrated in FIG. 2, the first printing mechanism includes the conveying path 440A in the casing 200. The conveying path 440A is so-called U-turn path. The conveying path 440A is an example of a "first path".

The conveying path 440A is indicated by an alternate long and short dash line in FIG. 2. The conveying path 440A includes a curved portion 441A and a straight portion 442A. The curved portion 441A is an example of a "first curved portion". The curved portion 441A has a supplying port 443A. The supplying port 443A is located just above an upper end of the guide surface 412A. The curved portion 441A extends upward from the supplying port 443A, and curves forward, i.e., toward the recording head 480A, at substantially the same height as the discharging port 444A. The straight portion 442A extends substantially linearly forward from a downstream end of the curved portion 441A, and reaches the discharging port 444A. The sheet 1A is fed to the supplying port 443A, and conveyed in a conveyance direction 5A in the conveying path 440A.

As illustrated in FIG. 2, the second printing mechanism includes the conveying path 440B in the casing 200. The conveying path 440B is located between the conveying path 440A and a rear end of the casing 200. The conveying path 440B is so-called U-turn path. The conveying path 440B is an example of a "second path".

The conveying path 440B is indicated by a two dotted line in FIG. 2. The conveying path 440B has a curved portion 441B and a straight portion 442B. The curved portion 441B is an example of a "second curved portion".

The curved portion 441B has a supplying port 443B. The supplying port 443B is located above and slightly behind an upper end of the guide surface 412B. The curved portion 441B extends upward from the supplying port 443B. The curved portion 441B curves forward, i.e., toward the recording head 480B, at a position above a downstream end of the curved portion 441A and substantially at the same height as the discharging port 444B. The straight portion 442B is continuous with a downstream end of the curved portion 441B. The straight portion 442B extends substantially linearly forward above the straight portion 442A, and reaches the discharging port 444B. The sheet 1B is fed to the supplying port 443B, and conveyed in a conveyance direction 5B in the conveying path 440B.

A length of the conveying path 440B is greater than a length of the conveying path 440A due to a length of the curved portion 441B being greater than a length of the curved portion 441A.

Pairs of Conveying Rollers 450A and 450B

As illustrated in FIG. 2, the pair of conveying rollers 450A includes two rollers that contact with each other at a position of a downstream end of the curved portion 441A, i.e., an upstream end of the straight portion 442A. The position where the two rollers of the pair of conveying rollers 450A contact with each other may be referred to as a "first nip position". One roller of the pair of conveying rollers 450A is a driving roller that is rotatable in response to receiving a driving force from the conveying motor 551A. The other roller of the pair of conveying rollers 450A is a driven roller that is rotatable by contacting the one roller from below. The pair of conveying rollers 450A is configured to nip the conveyed sheet 1A at the first nip position, and convey the sheet 1A forward. Accordingly, the sheet 1A is conveyed along the straight portion 442A.

As illustrated in FIG. 2, the pair of conveying rollers 450B includes two rollers that contact with each other at a position of a downstream end of the curved portion 441B, i.e., an upstream end of the straight portion 442B. The position where the two rollers of the pair of conveying rollers 450B contact with each other may be referred to as a "second nip position". One roller of the pair of conveying rollers 450B is a driving roller that is rotatable in response to receiving a driving force from the conveying motor 551B. The other roller of the pair of conveying rollers 450B is a driven roller that is rotatable by contacting the one roller from below. The pair of conveying rollers 450B is configured to nip the conveyed sheet 1B at the second nip position, and convey the sheet 1B forward. Accordingly, the sheet 1B is conveyed along the straight portion 442B.

Pairs of Discharging Rollers 460A and 460B

As illustrated in FIG. 2, the pair of discharging rollers 460A includes two rollers that contact with each other at a position between the platen 470A and the discharging port 444A in the front-rear direction 8. One roller of the pair of discharging rollers 460A is a driving roller that is rotatable in response to receiving a driving force from the conveying motor 551A. The other roller of the pair of discharging rollers 460A is a spur that is rotatable by contacting with the one roller from above. The pair of discharging rollers 460A is configured to nip the conveyed sheet 1A, and convey the sheet 1A forward. Accordingly, the sheet 1A is discharged from the discharging port 444A.

The pair of discharging rollers 460B includes two rollers that contact with each other at a position between the platen 470B and the discharging port 444B in the front-rear direction 8. One roller of the pair of discharging rollers 460B is a driving roller that is rotatable in response to receiving a driving force from the conveying motor 551B. The other roller of the pair of discharging rollers 460B is a spur that is rotatable by contacting with the one roller from above. The pair of discharging rollers 460B is configured to nip the conveyed sheet 1B, and convey the sheet 1B forward. Accordingly, the sheet 1B is discharged from the discharging port 444B.

Platens 470A and 470B

As illustrated in FIG. 2, the platen 470A is located between the pair of conveying rollers 450A and the pair of discharging rollers 460A in the front-rear direction 8. The platen 470A is configured to support the conveyed sheet 1A along the straight portion 442A. The platen 470B is located between the pair of conveying rollers 450B and the pair of discharging rollers 460B in the front-rear direction 8. The platen 470B is configured to support the conveyed sheet 1B along the straight portion 442B.

Recording Heads 480A and 480B

The recording head 480A is configured to eject ink toward the sheet 1A on the platen 470A by an inkjet mechanism to record an image. As illustrated in FIG. 2, the recording head 480A is located above the platen 470A and along the straight portion 442A. The recording head 480A is an example of a "first print engine". The recording head 480B is configured to eject ink toward the sheet 1B on the platen 470B by the inkjet mechanism to record an image. As illustrated in FIG. 2, the recording head 480B is located above the platen 470B and along the straight portion 442B. The recording head 480B is an example of a "second print engine".

Each of the recording heads 480A and 480B is a serial head. Nevertheless, each of the recording heads 480A and 480B may be a line head instead of the serial head. Each of the printing mechanism of the recording heads 480A and 480B may be an electrophotographic mechanism or a thermal transfer mechanism, instead of the inkjet mechanism.

Inner Guide 510, Outer Guide 520

As illustrated in FIG. 2, the inner guide 510 and the outer guide 520 are fixed to the frame in the casing 200 at positions between the inner side surfaces 207L and 207R when viewed from the rear side.

Figure 3:
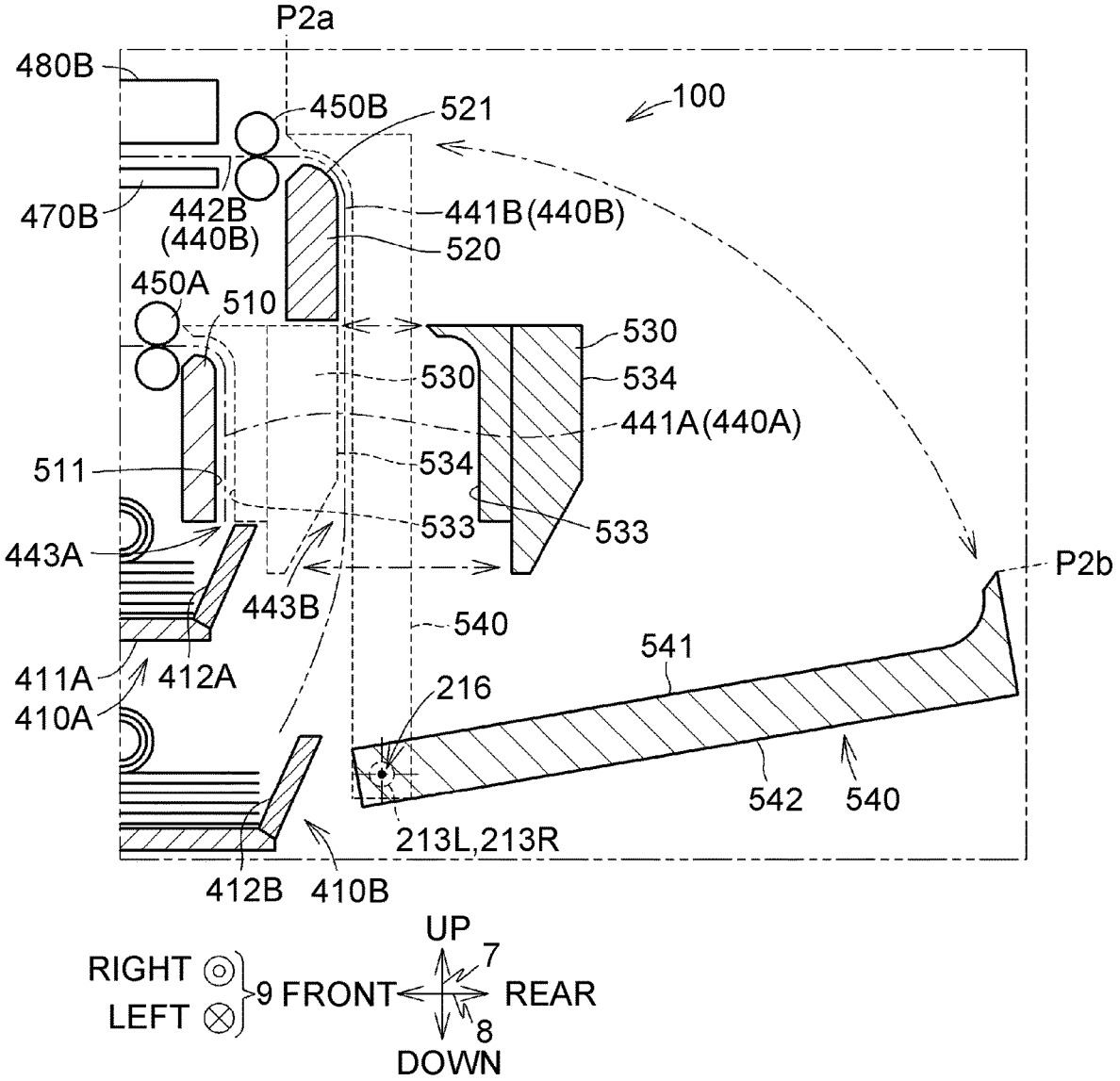
FIG. 3 is a partial cross-sectional view of the printer 100 taken along the dashed-dotted line II-II in FIG. 1A while the outer path cover 540 is at an opened position P2B.

As shown in FIG. 3, the inner guide 510 is located slightly behind the pair of conveying rollers 450A in the front-rear direction 8, and between the supplying port 443A and the first nip position in the up-down direction 7. The inner guide 510 has a guide surface 511 that defines front and lower sides of the curved portion 441A.

The outer guide 520 is located slightly behind the pair of conveying rollers 450B in the front-rear direction 8, and between the second nip position and an upper end of an inner path cover 530 in the up-down direction 7 while the inner path cover 530 is mounted at the casing 200. Hereinafter, unless otherwise stated, the description of "inner path cover 530" indicates "inner path cover 530 that is being mounted on the casing 200".

The outer guide 520 has a guide surface 521 that defines front and lower sides of the curved portion 441B.

Inner Path Cover 530

The inner path cover 530 is mounted at a mounting position between the inner side surfaces 207L and 207R in the casing 200. The inner path cover 530 is an example of a "first cover". The mounting position is an example of a "first closed position". The mounting position is substantially the same left-right position as a position of the inner guide 510. As illustrated in FIG. 2, the mounting position is behind a position of the inner guide 510. As illustrated in FIG. 3, the inner path cover 530 may be removed rearward, i.e., outward, from the casing 200.

The inner path cover 530 has an inner guide surface 533 and an outer guide surface 534. The inner guide surface 533 defines a rear side, i.e., an outer side, of the curved portion 441A. The outer guide surface 534 defines a front side, i.e., an inner side, of the curved portion 441B.

Each of the inner guide surface 533 and the outer guide surface 534 may be a single curved surface. Nevertheless, each of the inner guide surface 533 and the outer guide surface 534 may be a surface that is formed by tips of a plurality of ribs arranged at intervals in the left-right direction 9.

Outer Path Cover 540

As illustrated in FIG. 1B, the outer path cover 540 is located between the inner side surfaces 207L and 207R in the left-right direction 9. As illustrated in FIG. 2, an upper end of the outer path cover 540 is located above the second nip position. A lower end of the outer path cover 540 is located below an upper end of the guide surface 412B. The outer path cover 540 is an example of a "second cover".

As illustrated in FIG. 2, the outer path cover 540 is located behind the supplying trays 410A and 410B, the outer guide 520, and the inner path cover 530.

The outer path cover 540 has a guide surface 541. The guide surface 541 defines rear side and lower side of the curved portion 441B. The guide surface 541 may be a single curved surface. Nevertheless, the guide surface 541 may be a surface that is formed by tips of a plurality of ribs arranged at intervals in the left-right direction 9.

As illustrated in FIG. 1B, the printer 100 has shafts 213L and 213R. The shaft 213L protrudes from adjacent to a lower end of the inner side surface 207L. The shaft 213R protrudes from adjacent to a lower end of the inner side surface 207R. The shafts 213L and 213R face each other in the left-right direction 9. The shafts 213L and 213R have a common axis 216 extending in the left-right direction 9. The shafts 213L and 213R are configured to support the outer path cover 540 adjacent to a lower end thereof such that the outer path cover 540 is pivotable between a closed position P2A as illustrated in FIG. 2, and an opened position P2B as illustrated in FIG. 3.

As illustrated in FIG. 2, the outer path cover 540 is at the closed position P2A where the outer path cover 540 defines outside of the curved portion 441B of the conveying path 440B. The closed position P2A is an example of a "second closed position".

As illustrated in FIG. 3, the outer path cover 540 is at the opened position P2B when the outer path cover 540 is away from the closed position P2A toward outside of the casing 200 in the circumferential direction of the axis 216. Hereinafter, the circumferential direction may be also referred to as an "away direction". The guide surface 521 of the outer guide 520 and the outer guide surface 534 of the inner path cover 530 may be exposed externally when the outer path cover 540 is at the opened position P2B.

Hereinafter, unless otherwise stated, the description of "outer path cover 540" indicates "outer path cover 540 that is located at the closed position P2A".

As shown in FIG. 1B, the outer path cover 540 has a rear surface 542. The rear surface 542 is exposed externally between the rear surfaces 206L and 206R.

Cartridge Cover 550, Cartridges 670A and 670B

As illustrated in FIG. 4, the casing 200 includes accommodation spaces 210A and 210B that are arranged in the up-down direction 7 at lower right corner of the casing 200.

The accommodation space 210A may be opened forward. Four cartridges 670A may be accommodated in the accommodation space 210A. The cartridges 670A may be an ink cartridge storing ink therein, and made of material such as a plastic. Each of the four cartridges 670A is configured to communicate with the recording head 480A via corresponding ink tube.

The accommodation space 210B is located above the accommodation space 210A. The accommodation space 210B may be opened forward. Four cartridges 670B may be accommodated in the accommodation space 210B. The cartridges 670B may be an ink cartridge storing ink therein, and made of material such as a plastic. Each of the four cartridges 670B is configured to communicate with the recording head 480B via corresponding ink tube.

The cartridge cover 550 is supported by the casing 200 so as to be pivotable about an axis 551 extending in the up-down direction 7 between a closed position P31 as illustrated in FIG. 1A and an opened position P32 as illustrated in FIG. 4. As illustrated in FIG. 1A, the cartridge cover 550 at the closed position P31 may allow the cartridges 670A and 670B in the accommodation spaces 210A and 210B to be covered. As illustrated in FIG. 4, the cartridge cover 550 at the opened position P32 may allow the cartridges 670A and 670B in the accommodation spaces 210A and 210B to be exposed externally.

Sheet Sensors 610A and 610B

The sheet sensors 610A and 610B are configured to detect remaining amount of sheets.

As illustrated in FIG. 5, the sheet sensor 610A is configured to output sheet presence signal D1A. The sheet presence signal MA has different levels depending on the presence of the sheets 1A on the supplying trays 410A. The sheet sensor 610A includes a sensor 611A, a bracket 612A, an arm 613A, and a detected portion 614A.

Figure 6A:
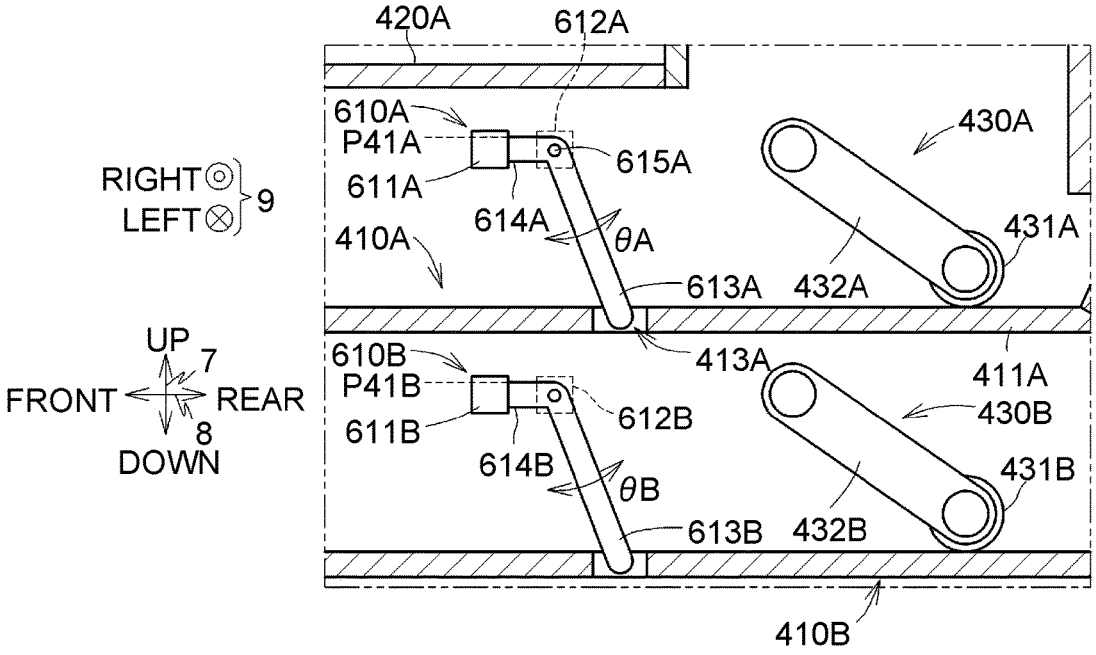
FIG. 6A is a schematic diagram illustrating sheet sensors 610A and 610B in FIG. 5.

The sensor 611A is an optical photointerrupter, and has a light emitter and a light receiver. As illustrated in FIG. 6A, the light emitter and the light receiver are located in the casing 200 above the supplying tray 410A, below the discharging tray 420A, and in front of the feeding mechanism 430A. The light emitter at this position faces the light receiver with an interval in the left-right direction 9, and emits light toward the light receiver. The light receiver outputs to the controller 660 the sheet presence signal D1A having a level corresponding to the amount of received light.

The bracket 612A is located in the casing 200 behind the sensor 611A and in front of the feeding mechanism 430A. The bracket 612A is configured to support an end portion of the arm 613A such that the arm 613A is rotatable in the circumferential direction θA of an axis 615A extending in the left-right direction 9.

The arm 613A extends rearward and downward from the bracket 612A, and is rotatable in the circumferential direction θA. The supplying tray 410A has a hole 413A at the bottom portion 411A. The hole 413A is located at a position where the bottom portion 411A intersects a track of a tip of the arm 613A in response to rotating of the arm 613A.

Figure 6B:
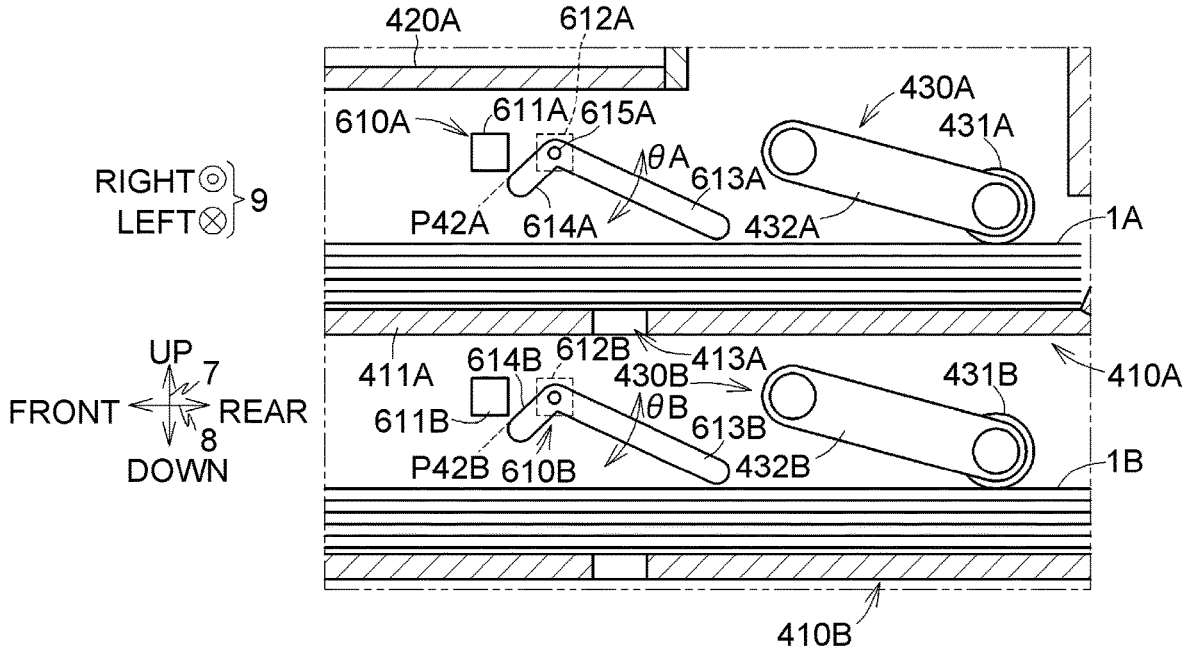
FIG. 6B is a schematic diagram illustrating the sheet sensors 610A and 610B in FIG. 5.

The detected portion 614A extends from the end portion of the arm 613A in a radial direction of the axis 615A. The detected portion 614A is rotatable between a light shielding position P41A as illustrated in FIG. 6A, and a separated position P42A illustrated in FIG. 6B in the circumferential direction θA. The detected portion 614A at the light shielding position P41A is located in a space between the light emitter of the sensor 611A and the light receiver of the sensor 611A. The detected portion 614A at the separated position P42A is located away from the light shielding position P41A in the circumferential direction θA of the axis 615A.

The detected portion 614A is located at the separated position P42A when the sheet 1A is between the tip of the arm 613A and the hole 413A due to presence of the sheet 1A on the supplying tray 410A. At this time, the sensor 611A outputs a high level sheet presence signal D1A. On the other hand, the detected portion 614A is located at the light shielding position P41A when the tip of the arm 613A is in the hole 413A due to absence of the sheet 1A on the supplying tray 410A. At this time, the sensor 611A outputs a low level sheet presence signal D1A.

As illustrated in FIG. 5, the sheet sensor 610B is configured to output sheet presence signal D1B. The sheet presence signal D1B has different levels depending on the presence of the sheets 1B on the supplying tray 410B. The sheet sensor 610B includes a sensor 611B, a bracket 612B, an arm 613B, and a detected portion 614B.

The sensor 611B is an optical photointerrupter, and has a light emitter and a light receiver. As illustrated in FIG. 6A, the light emitter and the light receiver are located in the casing 200 above the supplying tray 410B, below the supplying tray 410A, and in front of the feeding mechanism 430B. The light emitter at this position faces the light receiver with an interval in the left-right direction 9, and emits light toward the light receiver. The light receiver outputs to the controller 660 the sheet presence signal D1B having a level corresponding to the amount of received light.

The bracket 612B is located in the casing 200 behind the sensor 611B and in front of the feeding mechanism 430B. The bracket 612B is configured to support an end portion of the arm 613B such that the arm 613B is rotatable in the circumferential direction θB of an axis 615A extending in the left-right direction 9.

The arm 613A extends rearward and downward from the bracket 612B, and is rotatable in the circumferential direction θB. The supplying tray 410B has a hole 413B at the bottom portion 411B. The hole 413B is located at a position where the bottom portion 411B intersects a track of a tip of the arm 613B in response to rotating of the arm 613B.

The detected portion 614B extends from the end portion of the arm 613B in a radial direction of the axis 615B. The detected portion 614B is rotatable between a light shielding position P41B as illustrated in FIG. 6A, and a separated position P42B illustrated in FIG. 6B in the circumferential direction θB. The detected portion 614B at the light shielding position P41B is located in the space between the light emitter of the sensor 611B and the light receiver of the sensor 611B. The detected portion 614B at the separated position P42B is located away from the light shielding position P41B in the circumferential direction θB of the axis 615B.

The detected portion 614B is located at the separated position P42B when the sheet 1B is between the tip of the arm 613B and the hole 413B due to presence of the sheet 1B on the supplying tray 410B. At this time, the sensor 611B outputs a high level sheet presence signal D1B. On the other hand, the detected portion 614B is located at the light shielding position P41B when the tip of the arm 613B is in the hole 413B due to absence of the sheet 1B on the supplying tray 410B. At this time, the sensor 611B outputs a low level sheet presence signal D1B.

Registration Sensors 620A and 620B

As illustrated in FIG. 5, the registration sensor 620A is configured to output sheet presence signal D2A to the controller 660. The sheet presence signal D2A has different levels depending on the presence of the sheet 1A at downstream end of the curved portion 441A.

Figure 7:
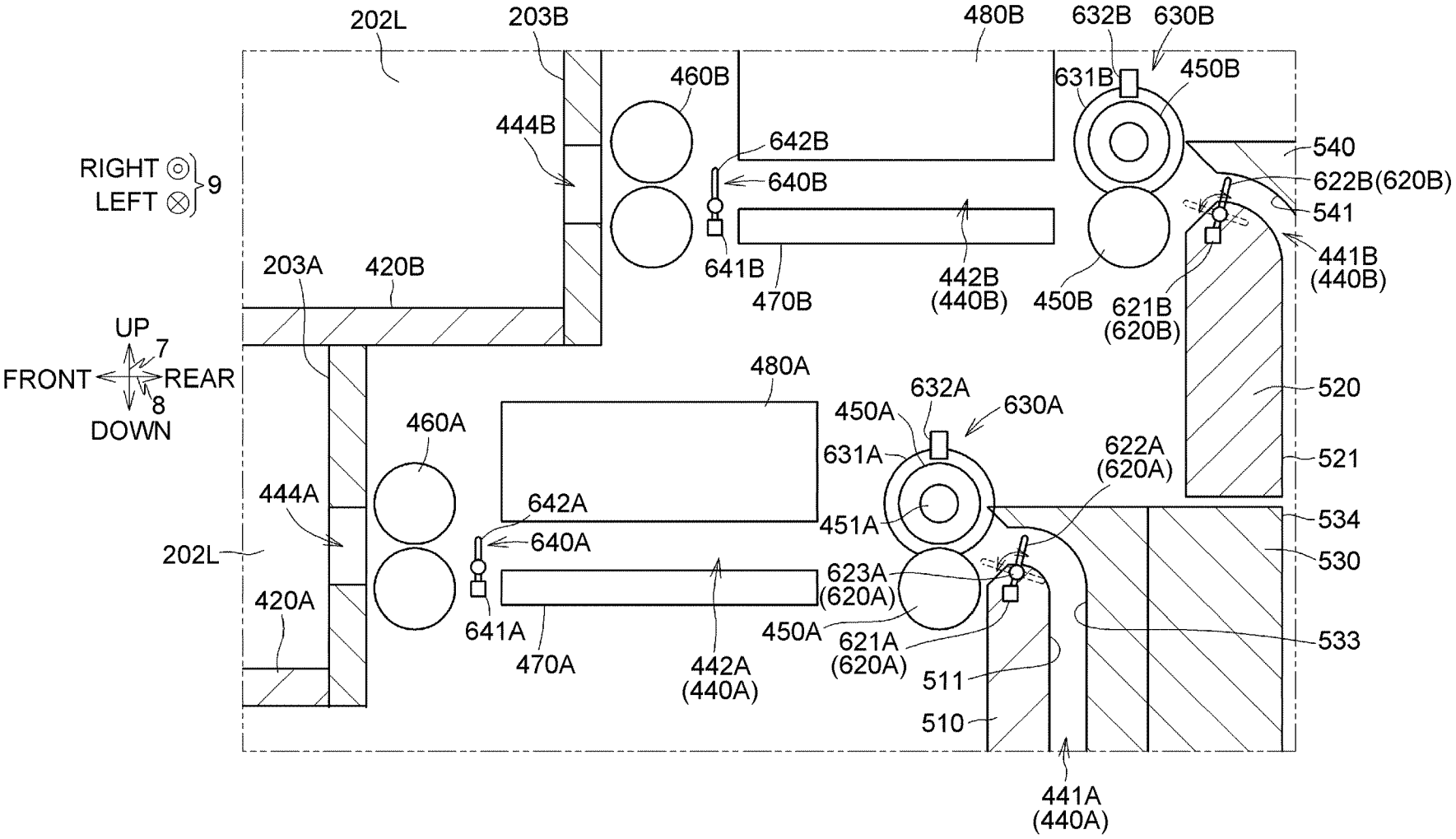
FIG. 7 is a schematic diagram illustrating registration sensors 620A and 620B, rotary encoders 630A and 630B, and discharging sensors 640A and 640B in FIG. 5.

As illustrated in FIG. 7, the registration sensor 620A includes a sensor 621A and a detected portion 622A.

The sensor 621A is an optical photointerrupter, and has a light emitter and a light receiver. The light emitter and the light receiver of the sensor 621A are located slightly behind the pair of conveying rollers 450A adjacent to the inner guide 510, and face each other in the left-right direction 9. The light emitter is configured to emit light toward the light receiver. The light receiver is configured to output to the controller 660 a sheet presence signal D2A having a level corresponding to the amount of received light.

The detected portion 622A is supported by the inner guide 510 such that the detected portion 622A is rotatable about an axis 623A extending in the left-right direction 9. The detected portion 622A has a first portion and a second portion. The first portion extends from the axis 623A toward the inside of the conveying path 440A and reaches inside of the conveying path 440A. The second portion extends from the axis 623A toward the sensor 621A. While the sheet 1A is not in contact with the first portion, the second portion is located at a light shielding position that is between the light emitter and the light receiver. At this time, the sensor 621A is configured to output a low level sheet presence signal D2A. On the other hand, while the sheet 1A is in contact with the first portion, the second portion is located at a separated position that is away from the light shielding position in the circumferential direction of the axis 623A. At this time, the sensor 621A is configured to output a high level sheet presence signal D2A. In FIG. 7, the other end of the detected portion 622A at the light shielding position and the separated position are indicated by a solid line and a dashed line, respectively.

As illustrated in FIG. 5, the registration sensor 620B is configured to output sheet presence signal D2B to the controller 660. The sheet presence signal D2B has different levels depending on the presence of the sheet 1B at downstream end of the curved portion 441B. As illustrated in FIG. 7, the registration sensor 620B includes a sensor 621B and a detected portion 622B.

The sensor 621B is an optical photointerrupter, and has a light emitter and a light receiver. The light emitter and the light receiver of the sensor 621B are located slightly behind the pair of conveying rollers 450B adjacent to the outer guide 520, and face each other in the left-right direction 9. The light emitter is configured to emit light toward the light receiver. The light receiver is configured to output to the controller 660 a sheet presence signal D2B having a level corresponding to the amount of received light.

The detected portion 622B is supported by the outer guide 520 such that the detected portion 622B is rotatable about an axis 623B extending in the left-right direction 9. The detected portion 622B has a first portion and a second portion. The first portion extends from the axis 623B toward the inside of the conveying path 440B and reaches inside of the conveying path 440B. The second portion extends from the axis 623B toward the sensor 621B. While the sheet 1B is not in contact with the first portion, the second portion is located at a light shielding position that is between the light emitter and the light receiver. At this time, the sensor 621B is configured to output a low level sheet presence signal D2B. On the other hand, while the sheet 1B is in contact with the first portion, the second portion is located at a separated position that is away from the light shielding position in the circumferential direction of the axis 623B. At this time, the sensor 621B is configured to output a high level sheet presence signal D2B. In FIG. 7, the other end of the detected portion 622B at the light shielding position and the separated position are indicated by a solid line and a dashed line, respectively.

Rotary Encoders 630A and 630B

As illustrated in FIG. 7, the rotary encoder 630A includes an encoder disk 631A and a sensor 632A. The encoder disk 631A has a substantially disk-shape that is thin in the left-right direction 9. The encoder disk 631A and the driving roller of the pair of conveying rollers 450A have the common rotational axis 451A. The encoder disk 631A has a plurality of holes penetrated through the encoder disk 631A in the left-right direction 9. The plurality of holes are arranged along periphery of the encoder disk 631A at equal intervals in the circumferential direction of the rotational axis 451A.

The sensor 632A is an optical photointerrupter, and has a light emitter and a light receiver. The light emitter and the light receiver are located with a space therebetween in the left-right direction 9. The encoder disk 631A is located such that the plurality of holes of the encoder disk 631A pass the space as the encoder disk 631A rotates. The light emitter is configured to emit light toward the periphery of the encoder disk 631A. As illustrated in FIG. 5, the light receiver is configured to output to the controller 660 a pulse signal D3A having a level corresponding to the amount of received light that passes each hole. The pulse signal D3A has a different level between a high level and a low level according to the rotation of the encoder disk 631A.

As illustrated in FIG. 7, the rotary encoder 630B includes an encoder disk 631B and a sensor 632B. The encoder disk 631B has a substantially disk-shape that is thin in the left-right direction 9. The encoder disk 631B and the driving roller of the pair of conveying rollers 450B have the common rotational axis 451B. The encoder disk 631B has a plurality of holes penetrated through the encoder disk 631A in the left-right direction 9. The plurality of holes are arranged along periphery of the encoder disk 631B at equal intervals in the circumferential direction of the rotational axis 451B.

The sensor 632B is an optical photointerrupter, and has a light emitter and a light receiver. The light emitter and the light receiver are located with a space therebetween in the left-right direction 9. The encoder disk 631B is located such that the plurality of holes of the encoder disk 631B pass the space as the encoder disk 631B rotates. The light emitter is configured to emit light toward the periphery of the encoder disk 631B. As illustrated in FIG. 5, the light receiver is configured to output to the controller 660 a pulse signal D3B having a level corresponding to the amount of received light that passes each hole. The pulse signal D3B has a different level between a high level and a low level according to the rotation of the encoder disk 631B.

Discharging Sensors 640A and 640B

As illustrated in FIG. 5, the discharging sensor 640A is configured to output sheet presence signal D4A to the controller 660. The sheet presence signal D4A has different levels depending on the presence of the sheet 1A at downstream end of the straight portion 442A.

The discharging sensor 640A has a sensor 641A and a rotatable detected portion 642A. The discharging sensor 640A is configured to output a sheet presence signal D4A from the sensor 641A to the controller 660 according to the rotation of the detected portion 642A. The high level sheet presence signal D4A indicates that the sheet 1A is present at the downstream end of the straight portion 442A. The low level sheet presence signal D4A indicates that the sheet 1A is not present at the downstream end of the straight portion 442A.

As illustrated in FIG. 5, the discharging sensor 640B is configured to output sheet presence signal D4B to the controller 660. The sheet presence signal D4B has different levels depending on the presence of the sheet 1B at downstream end of the straight portion 442B.

The discharging sensor 640B has a sensor 641B and a rotatable detected portion 642B. The discharging sensor 640B is configured to output a sheet presence signal D4B from the sensor 641B to the controller 660 according to the rotation of the detected portion 642B. The high level sheet presence signal D4B indicates that the sheet 1B is present at the downstream end of the straight portion 442B. The low level sheet presence signal D4B indicates that the sheet 1B is not present at the downstream end of the straight portion 442B.

Ink Sensors 650A and 650B

Figure 8A:
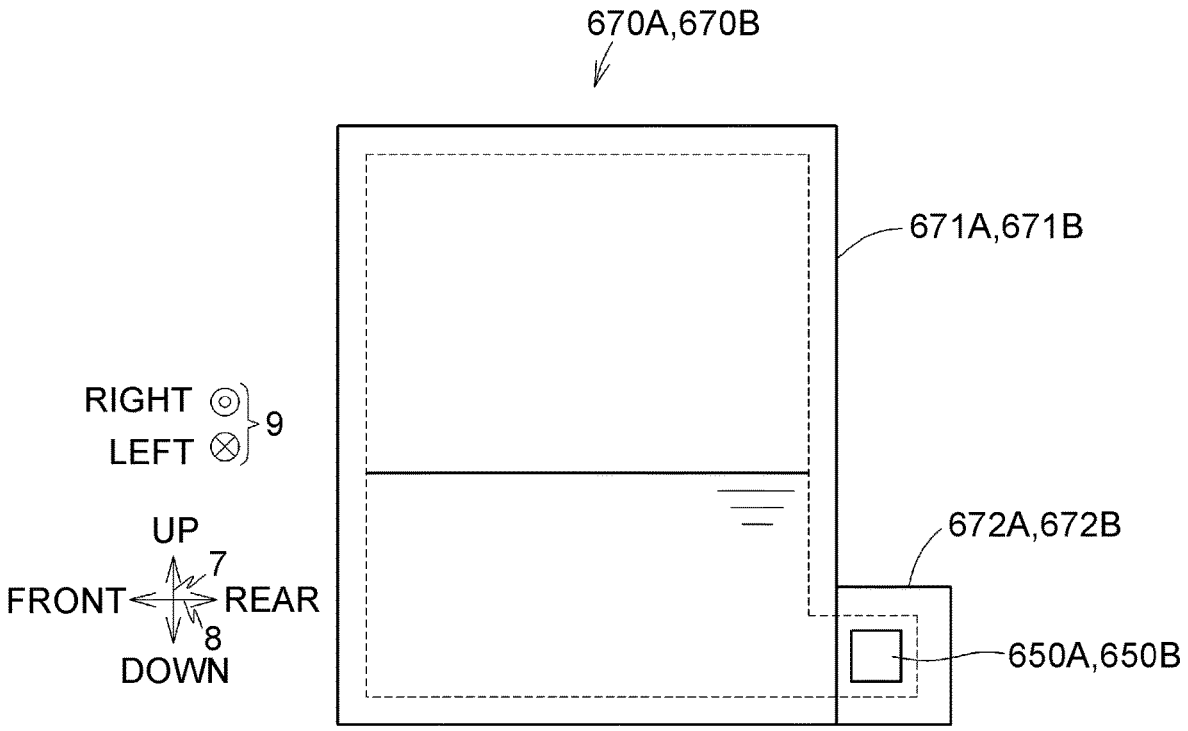
FIG. 8A is a schematic diagram illustrating ink sensors 650A and 650B in FIG. 5.
Figure 8B:
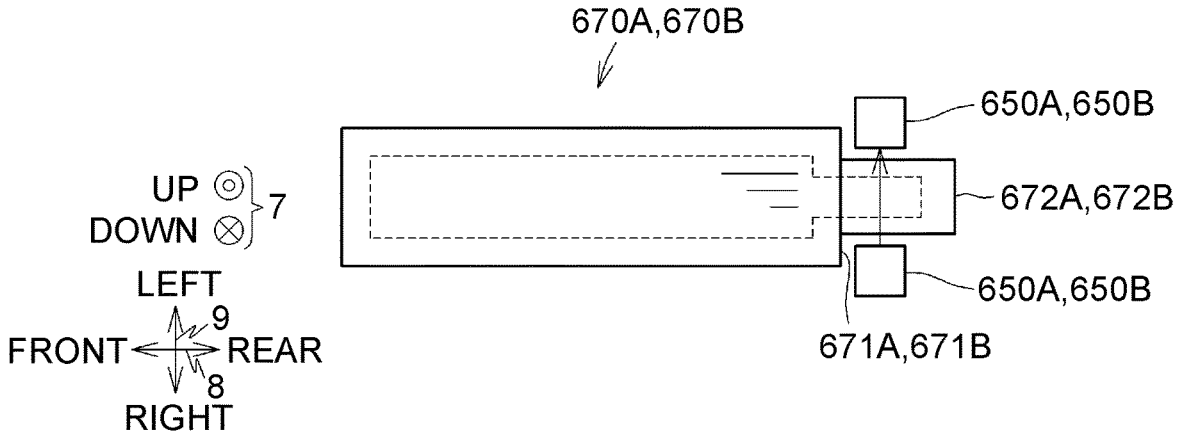
FIG. 8B is a schematic diagram illustrating ink sensors 650A and 650B in FIG. 5.

The ink sensor 650A is configured to detect remaining amount of ink in the cartridge 670A. As illustrated in FIGS. 8A and 8B, the cartridge 670A has a protruding portion 672A that protrudes rearward from position adjacent to lower end of a rear surface 671A of the cartridge 670A. As illustrated in FIG. 8B, a width of the protruding portion 672A in the left-right direction 9 is less than a maximum width of the cartridge 670A in the left-right direction 9. FIGS. 8A and 8B illustrate only one of the cartridges 670A.

Each of the four ink sensors 650A is configured to detect the amount of ink of a corresponding color in the cartridge 670A. Each of the four ink sensors 650A is such as an optical photointerrupter, and has a light emitter and a light receiver. As illustrated in FIG. 8A, the light emitter and the light receiver is located at a detection position adjacent to lower end of the protruding portion 672A. As illustrated in FIG.

8B, the light emitter and the light receiver face each other in the left-right direction 9. The remaining amount of ink in the cartridge 670A may be detected to be empty or close to empty according to the detection position. Hereinafter, the term "remaining amount of ink is empty" means that the remaining amount of ink is empty or close to empty, e.g., less than a certain amount. The light emitter is configured to emit light that may pass through the cartridge 670A and ink in the cartridge 670A toward the light receiver. As illustrated in FIG. 5, the light receiver is configured to output to the controller 660 an ink remaining signal D5A having a level corresponding to the amount of received light. The high level ink remaining signal D5A indicates that the remaining amount of ink is empty, e.g., less than the certain amount. The low level ink remaining signal D5A indicates that the remaining amount of ink is not empty.

The ink sensor 650B is configured to detect remaining amount of ink in the cartridge 670B. As illustrated in FIGS. 8A and 8B, the cartridge 670B has a protruding portion 672B that protrudes rearward from position adjacent to lower end of a rear surface 671B of the cartridge 670B. As illustrated in FIG. 8B, A width of the protruding portion 672B in the left-right direction 9 is less than a maximum width of the cartridge 670B in the left-right direction 9. FIGS. 8A and 8B illustrate only one of the cartridges 670B.

Each of the four ink sensors 650B is configured to detect the amount of ink of a corresponding color in the cartridge 670B. Each of the four ink sensors 650B is such as the optical photointerrupter, and has a light emitter and a light receiver. As illustrated in FIG. 8A, the light emitter and the light receiver is located at a detection position adjacent to lower end of the protruding portion 672B. As illustrated in FIG. 8B, the light emitter and the light receiver face each other in the left-right direction 9. The remaining amount of ink in the cartridge 670B may be detected to be empty, e.g., less than a certain amount, according to the detection position. The light emitter is configured to emit light that may pass through the cartridge 670B and ink in the cartridge 670B toward the light receiver. As illustrated in FIG. 5, the light receiver is configured to output to the controller 660 an ink remaining signal D5B having a level corresponding to the amount of received light. The high level ink remaining signal D5B indicates that the remaining amount of ink is empty, e.g., less than the certain amount. The low level ink remaining signal D5B indicates that the remaining amount of ink is not empty.

Cover Sensors 680A and 680B

The cover sensor 680A includes a mechanical switch, and configured to detect whether the inner path cover 530 is opening. The inner path cover 530 at the mounting position causes the cover sensor 680A to contact a part of the inner path cover 530 and output to the controller 660 a high level cover opening signal D6A. The inner path cover 530 away from the mounting position causes the cover sensor 680A to not contact the inner path cover 530 and to output to the controller 660 a low level cover opening signal D6A.

The cover sensor 680B includes a mechanical switch, and configured to detect whether the outer path cover 540 is opening. The cover sensor 680B is disposed at different position with the cover sensor 680A in the casing 200. The outer path cover 540 at the closed position P2A causes the cover sensor 680B to contact a part of the outer path cover 540 and output to the controller 660 a high level cover opening signal D6B. The outer path cover 540 is away from the closed position P2A. e.g., at the opened position P2B as illustrated in FIG. 3, causes the cover opening sensor 680B to not contact the outer path cover 540 and to output to the controller 660 a low level cover opening signal D6B.

Controller 660

As illustrated in FIG. 5, the controller 660 includes a control circuit board, and a CPU, a ROM, a RAM, an EEPROM, and an ASIC each mounted on the control circuit board. The CPU, the ROM, the RAM, the EEPROM, and the ASIC are configured to communicate with each other via an internal bus. The ROM stores programs for controlling operation of the printer 100. The CPU is configured to execute the programs stored in the RAM and the EEPROM.

The controller 660 is configured to receive image data from an information processing apparatus that may communicate with the printer 100. The controller 660 is configured to control each component of the printer 100 to record an image based on the received image data.

The communication interface 690 is a communication interface such as a wireless LAN, a wired LAN, or a USB. The communication interface 690 is configured to receive various data from the information processing apparatus. The communication interface 690 is configured to send the received various data to the controller 660.

Operations of Printer 100 and Information Processing Apparatus 700

Hereinafter, processes of the printer 100 will be described with reference to FIGS. 1 to 11. The printer 100 receives a recording instruction from the information processing apparatus 700, and records an image on the sheet 1A or the sheet 1B based on the recording instruction. The information processing apparatus 700 is an example of an "external device", and is such as a personal computer or a smartphone. The recording instruction may be also referred to as a "print job".

The information processing apparatus 700 generates the recording instruction including a start code, a plurality of pieces of image data, and an end code. Each piece of the image data represents a target image that is to be printed by the printer 100. Each piece of the image data has a page number indicating a sequence of printing. The printer 100 receives the recording instruction via the communication interface 690, and stores them into the RAM.

The information processing apparatus 700 sends to the printer 100 the start code, and the plurality of pieces of image data in accordance with the sequence of printing. The information processing apparatus 700 sends the end code to the printer 100 after sending a last piece of the image data in the sequence of printing.

Figure 9:
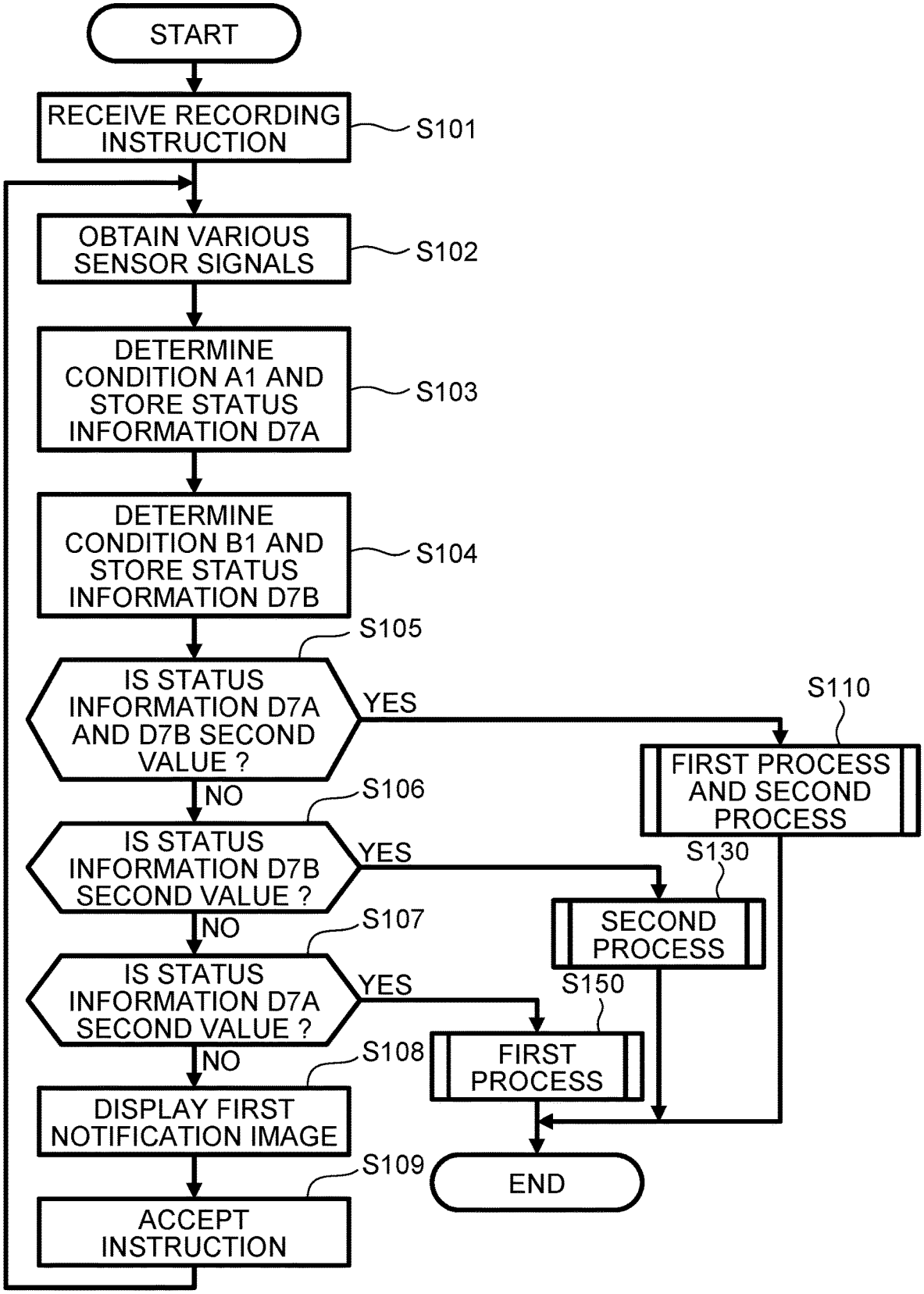
FIG. 9 is a flowchart of processing executed by a controller 660 in response to receiving a recording instruction.

In S101 of FIG. 9, the controller 660 receives the recording instruction and then stores the recording instruction in the RAM.

In S102, the controller 660 obtains signals of various sensors. The signals include the sheet presence signals D1A and D1B, the ink remaining signals D5A and D5B, and the cover opening signals D6A and D6B.

In S103, the controller 660 determines whether a condition A1 is satisfied, and stores in the RAM status information D7A indicating the determination result. The condition A1 is an example of a condition in which "an error has occurred". The condition A1 includes at least one from a group of (1) a condition in which the sheet presence signal D1A is at a low level, i.e., the sheet 1A is absent on the supplying tray 410A, (2) a condition in which the ink remaining signal D5A is at a high level, i.e., the remaining amount of ink in the cartridge 670A is empty, and (3) a condition in which the cover opening signal D6A is at a low level, i.e., the inner path cover 530 is open.

In S104, the controller 660 determines whether a condition B1 is satisfied, and stores in the RAM status information D7B indicating the determination result. The condition B1 is an example of a condition in which "an error has occurred". The condition B1 includes at least one from a group of (1) a condition in which the sheet presence signal D1B is at a low level, i.e., the sheet 1B is absent on the supplying tray 410B, (2) a condition in which the ink remaining signal D5B is at a high level, i.e., the remaining amount of ink in the cartridge 670B is empty, and (3) a condition in which the cover opening signal D6B is at a low level, i.e., the outer path cover 540 is open.

The status information D7A has either of a first value or a second value. The first value indicates that the condition A1 is satisfied. The second value indicates that the condition A1 is not satisfied. The status information D7B has either of the first value or the second value. The first value indicates that the condition B1 is satisfied. The second value indicates that the condition B1 is not satisfied.

In S105, the controller 660 determines whether each of the status information D7A and D7B is the second value. If the controller 660 determines that each of the status information D7A and D7B is the second value (YES in S105), the controller 660 proceeds to a step S110. In S110 the controller 660 executes a first process and a second process.

If NO in S105, in S106 the controller 660 determines whether the status information D7B is the second value. If the controller 660 determines that the status information D7B is the second value (YES in S106), the controller 660 proceeds to a step S130. In S130, the controller 660 executes the second process without executing the firstprocess.

If NO in S106, in S107 the controller 660 determines whether the status information D7A is the second value. If the controller 660 determines that the status information D7A is the second value (YES in S107), the controller 660 proceeds to a step S150. In S150, the controller 660 executes the first process without executing the second process.

If NO in S107, in S108 the controller 660 displays a first notification image on a display. The first notification image may be for prompting a user's operation such as replenishment of the sheets 1A and 1B, replacement of the cartridges 670A and 670B, replenishment of ink in the cartridges 670A and 670B, closing the outer path cover 540, or mounting the inner path cover 530. In S109, the controller 660 accepts instruction from the user through an operation button after the user finishes the operations, and then returns to the step S102.

Both First Process and Second Process (S110)

Processing of S110 will be described in detail with reference to FIG. 10. The first process includes a first conveying process and a first recording process. The first conveying process is for conveying the sheet 1A in the conveying path 440A, and includes a first cueing, a first intermittent conveyance, and a first discharging. The first recording process is for recording an image by the recording head 480A. The second process includes a second conveying process and a second recording process. The second conveying process is for conveying the sheet 1B in the conveying path 440B, and includes a second cueing, a second intermittent conveyance, and a second discharging. The second recording process is for recording an image by the recording head 480B.

In S111, the controller 660 sets each of the plurality of pieces of image data stored in the RAM into either of first image data or second image data. The first image data is to be recorded in the first recording process. The second image data is to be recorded in the second recording process. In this embodiment, a plurality of pieces of image data arranged at latter half in the sequence of printing are set to the first image data. A plurality of pieces of image data arranged at former half in the sequence of printing are set to the second image data.

The controller 660 executes the first process in steps S112A to S124A, and the second process in steps S112B to S124B. The controller 660 executes the first process and the second process in parallel. The controller 660 repeats the first process by the number of pieces of the first image data. The controller repeats the second process by the number of pieces of the second image data.

In S112A, the controller 660 executes the first cueing. The controller 660 outputs a control signal to the conveying motor 551A such that the sheet 1A is conveyed to a first start position at which a downstream end of the sheet 1A in the conveyance direction 5A faces the recording head 480A.

The outputted control signal causes the feeding roller 431A and the pair of conveying rollers 450A to rotate by a first rotation amount at a first conveying speed during a first conveying time. Accordingly, the sheet 1A is conveyed from the supplying tray 410A to the first start position.

In S113A, the controller 660 receives the sheet presence signal D2A and the pulse signal D3A. In S114A, the controller 660 determines whether a condition A2 is satisfied based on the received sheet presence signal D2A and the pulse signal D3A. The condition A2 includes a condition in which the sheet presence signal D2A remains the low level until a first determination time elapses after the first cueing starts, i.e., the sheet 1A is jammed in the curved portion 441A. The controller 660 proceeds to a step S122A if the controller 660 determines that the condition A2 is satisfied. The controller 660 proceeds to a step S115A if the controller 660 determines that the condition A2 is not satisfied. The first determination time is determined by experiments or simulations in a design stage of the printer 100.

In S115A, the controller 660 receives the cover opening signal D6A. In S116A, the controller 660 determines whether a condition A3 is satisfied based on the received cover opening signal D6A. The condition A3 includes a condition in which the cover opening signal D6A is at a low level, i.e., the inner path cover 530 is open. The controller 660 proceeds to a step S122A if the controller 660 determines that the condition A3 is satisfied. The controller 660 proceeds to a step S117A if the controller 660 determines that the condition A3 is not satisfied.

In S117A, the controller 660 executes the first intermittent conveyance and the first recording process. In the first intermittent conveyance, the controller 660 outputs a control signal to the conveying motor 551A to rotate the pair of conveying rollers 450A and the pair of discharging rollers 460A, thereby repeatedly conveying the sheet 1A by a first specific distance in the conveyance direction 5A and stopping the conveyance. In the first recording process, the controller 660 causes the recording head 480A to eject ink toward the sheet 1A. Accordingly, the image represented by the first image data is recorded on the sheet 1A.

In S118A, the controller 660 periodically receives signals of various sensors during the first intermittent conveyance and the first recording process. The received signals include the sheet presence signal D1A, the pulse signal D3A, the sheet presence signal D4A, the ink remaining signal DSA, and the cover opening signal D6A. In S119A, the controller 660 determines whether a condition A4 is satisfied based on the received signals. The condition A4 includes at least one from a group of (1) a condition in which the sheet presence signal MA is at the low level, i.e., the sheet 1A is absent on the supplying tray 410A, (2) a condition in which the sheet presence signal D4A remains the low level until a third determination time elapses after the first intermittent conveyance starts, i.e., the sheet 1A is not discharged from the discharging port 444A, (3) a condition in which the ink remaining signal D5A is at the high level, i.e., the remaining amount of ink in the cartridge 670A is empty, and (4) a condition in which the cover opening signal D6A is at the low level, i.e., the inner path cover 530 is open. The controller 660 proceeds to the step S122A if the controller 660 determines that the condition A4 is satisfied. On the other hand, the controller 660 proceeds to a step S120A if the controller 660 determines that the condition A4 is not satisfied.

In S120A, the controller 660 executes a first discharging. In the first discharging, the controller 660 causes the pair of conveyance rollers 450A and the pair of discharging rollers 460A to rotate, thereby discharging the sheet 1A from the discharging port 444A to the discharge tray 420A. In S120A, the controller 660 periodically receives signals of various sensors including a pulse signal D3A and a sheet presence signal D4A during the first discharging. In S121A, the controller 660 determines whether a condition A5 is satisfied based on the received signals. The condition A5 includes a condition in which the sheet presence signal D4A remains the high level until a fifth determination time elapses after the first discharging starts, i.e., the sheet 1A is not discharged from the discharging port 444A. The controller 660 proceeds to the step S122A if the controller 660 determines that the condition A5 is satisfied. The controller 660 proceeds to a step S124A if the controller 660 determines that the condition A5 is not satisfied.

In S122A, the controller 660 stops the first process and the second process. The controller 660 stops the output of control signals to the conveying motors 551A and 551B, thereby stopping the rotation of the feeding rollers 431A and 431B, and the pairs of conveying rollers 450A and 450B. The controller 660 stops the ejection of ink from the recording heads 480A and 480B.

In S123A, the controller 660 displays a second notification image on the display. The second notification image may be for prompting a user's operations such as removal of the jammed sheet 1A, replenishment of the sheet 1A, replacement of the cartridges 670A, replenishment of ink in the cartridges 670A, or mounting the inner path cover 530. In S123A, the controller 660 accepts instruction from the user through an operation button after the user finishes the operations, and then returns to the steps S112A and S112B.

In S124A, the controller 660 determines whether the first process for all pieces of the first image data has been finished. If the controller 660 determines that the first process has been finished (YES in S124A), the controller 660 ends the processing of FIG. 10. On the other hand, if the controller 660 determines that the first process has not been finished (NO in S121A), the controller 660 returns to the step S112A, and continues the first process for remaining pieces of the first image data.

In S112B, the controller 660 executes the second cueing. The controller 660 outputs a control signal to the conveying motor 551B such that the sheet 1B is conveyed to a second start position at which a downstream end of the sheet 1B in the conveyance direction 5B faces the recording head 480B. The outputted control signal causes the feeding roller 431B and the pair of conveying rollers 450B to rotate by a first rotation amount at a first conveying speed during a first conveying time. Accordingly, the sheet 1B is conveyed from the supplying tray 410B to the second start position.

In S113B, the controller 660 receives the sheet presence signal D2B and the pulse signal D3B. In S114B, the controller 660 determines whether a condition B2 is satisfied based on the received sheet presence signal D2B and the pulse signal D3B. The condition B2 includes a condition in which the sheet presence signal D2B remains the low level until a second determination time elapses after the second cueing starts, i.e., the sheet 1B is jammed in the curved portion 441B. The controller 660 proceeds to a step S122B if the controller 660 determines that the condition B2 is satisfied. The controller 660 proceeds to a step S115B if the controller 660 determines that the condition B2 is not satisfied. The second determination time is determined by experiments or simulations in a design stage of the printer 100.

In S115B, the controller 660 receives the cover opening signal D6B. In S116B, the controller 660 determines whether a condition B3 is satisfied based on the received cover opening signal D6B. The condition B3 includes a condition in which the cover opening signal D6B is at a low level, i.e., the outer path cover 540 is open. The controller 660 proceeds to a step S122B if the controller 660 determines that the condition B3 is satisfied. The controller 660 proceeds to a step S117B if the controller 660 determines that the condition B3 is not satisfied.

In S117B, the controller 660 executes the second intermittent conveyance and the second recording process. In the second intermittent conveyance, the controller 660 outputs a control signal to the conveying motor 551B to rotate the pair of conveying rollers 450B and the pair of discharging rollers 460B, thereby repeatedly conveying the sheet 1B by a second specific distance in the conveyance direction 5B and stopping the conveyance. In the second recording process, the controller 660 causes the recording head 480B to eject ink toward the sheet 1B. Accordingly, the image represented by the second image data is recorded on the sheet 1B.

In S118B, the controller 660 periodically receives signals of various sensors during the second intermittent conveyance and the second recording process. The received signals include the sheet presence signal D1B, the pulse signal D3B, the sheet presence signal D4B, the ink remaining signal D5B, and the cover opening signal D6B. In S119B, the controller 660 determines whether a condition B4 is satisfied based on the received signals. The condition B4 includes at least one from a group of (1) a condition in which the sheet presence signal D1B is at the low level, i.e., the sheet 1B is absent on the supplying tray 410B, (2) a condition in which the sheet presence signal D4B remains at the low level until a fourth determination time elapses after the second intermittent conveyance starts, i.e., the sheet 1B is not discharged from the discharging port 444B, (3) a condition in which the ink remaining signal D5B is at the high level, i.e., the remaining amount of ink in the cartridge 670B is empty, and (4) a condition in which the cover opening signal D6B is at the low level, i.e., the outer path cover 540 is open. The controller 660 proceeds to the step S122B if the controller 660 determines that the condition B4 is satisfied. On the other hand, the controller 660 proceeds to a step S120B if the controller 660 determines that the condition B4 is not satisfied.

In S120B, the controller 660 executes a second discharging. In the second discharging, the controller 660 causes the pair of conveyance rollers 450B and the pair of discharging rollers 460B to rotate, thereby discharging the sheet 1B from the discharging port 444B to the discharging tray 420B. In S120B, the controller 660 periodically receives signals of various sensors including a pulse signal D3B and a sheet presence signal D4B during the second discharging. In S121B, the controller 660 determines whether a condition B5 is satisfied based on the received signals. The condition B5 includes a condition in which the sheet presence signal D4B remains the high level until a sixth determination time elapses after the second discharging starts, i.e., the sheet 1B is not discharged from the discharging port 444B. The controller 660 proceeds to the step S122B if the controller 660 determines that the condition B5 is satisfied. The controller 660 proceeds to a step S124B if the controller 660 determines that the condition B5 is not satisfied.

In S122B, the controller 660 stops the second process while continuing the first process. The controller 660 stops the output of control signals to the conveying motor 551B, thereby stopping the rotation of the feeding roller 431B, the pair of conveying rollers 450B, and the pair of discharging rollers 460B. The controller 660 stops the ejection of ink from the recording head 480B.

In S123B, the controller 660 displays a third notification image on the display. The third notification image may be for prompting a user's operations such as removal of the jammed sheet 1B, replenishment of the sheet 1B, replacement of the cartridges 670B, replenishment of ink in the cartridges 670B, or closing the outer path cover 540. In S123B, the controller 660 accepts instruction from the user through an operation button after the user finishes the operations, and then returns to the step S112B.

In S124B, the controller 660 determines whether the second process for all pieces of the second image data has been finished. If the controller 660 determines that the second process has been finished (YES in S124B), the controller 660 ends the processing of FIG. 10. On the other hand, if the controller 660 determines that the second process has not been finished (NO in S121B), the controller 660 returns to the step S112B, and continues the second process for remaining pieces of the second image data.

Second Process Only (S130)

Figure 11A:
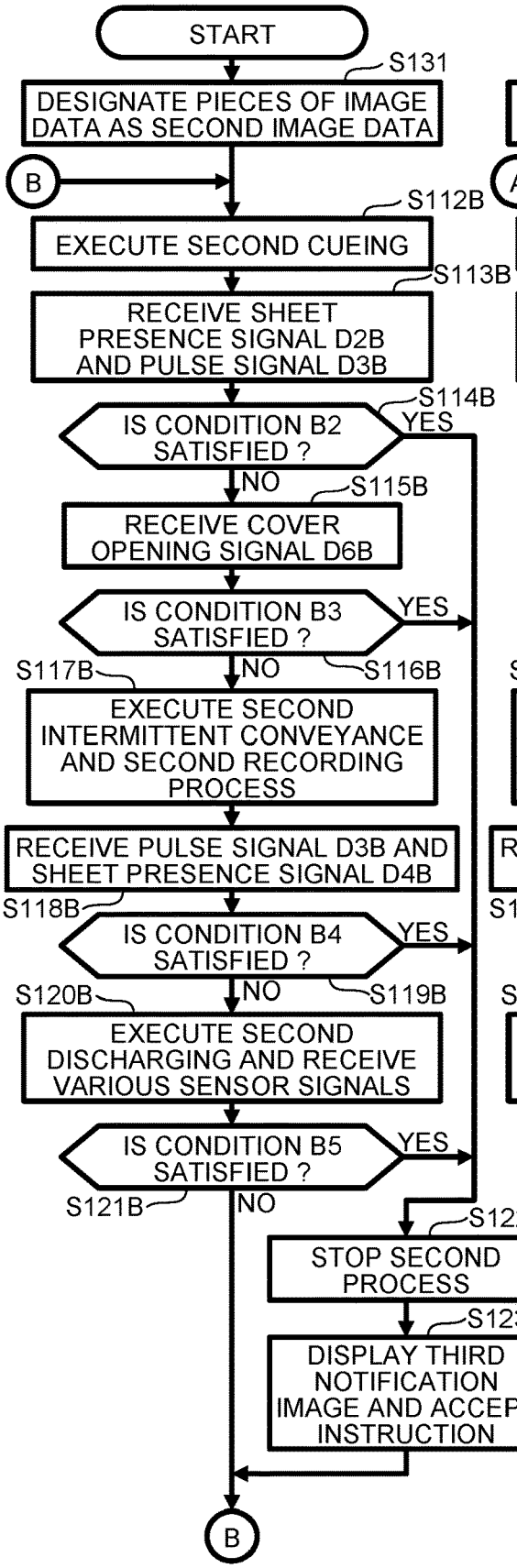
FIG. 11A is a flowchart of detailed processing of a step S130 in FIG. 9.

Processing of S130 will be described in detail with reference to FIG. 11A. As illustrated in FIG. 11A, the controller 660 executes a step S131, and then executes steps S112B to 123B, which are already described. In the following, description of steps S112B to S123B may be simplified.

In S131 of FIG. 11A, the controller 660 sets the plurality of pieces of image data stored in the RAM to second image data. The second image data is to be recorded in the second recording process. The controller 660 then executes the steps S112B to S123B.

First Process Only (S150)

Figure 11B:
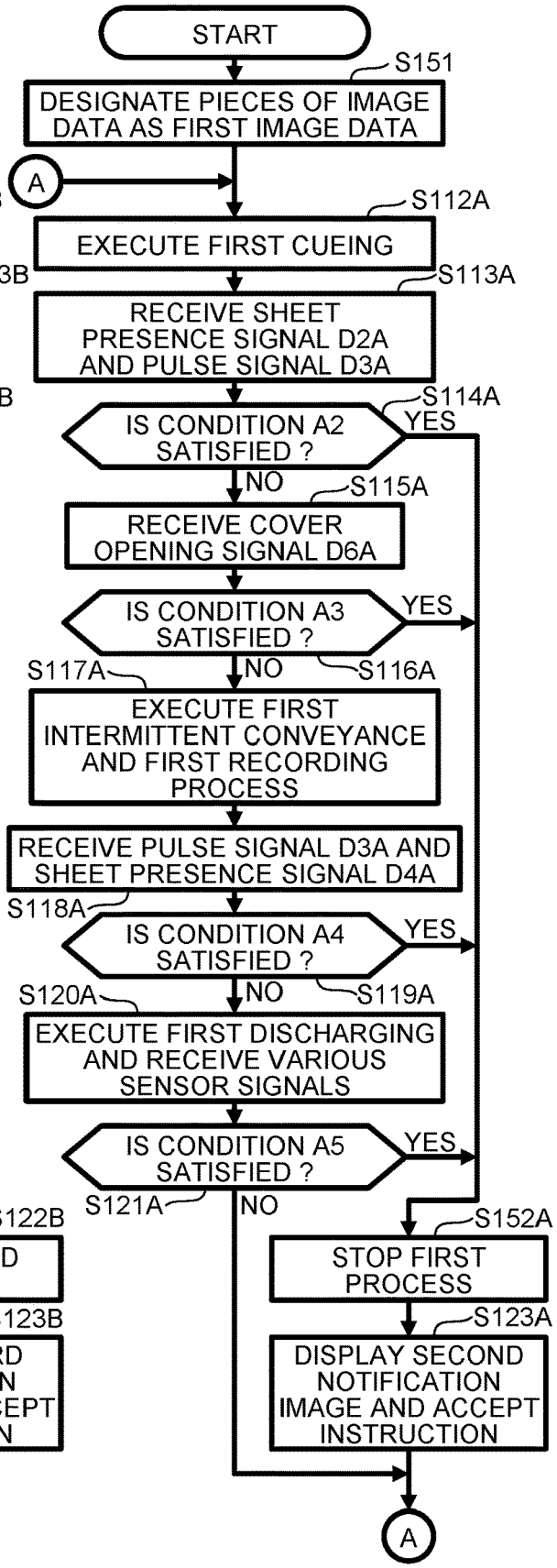
FIG. 11B is a flowchart of detailed processing of a step S150 in FIG. 9.

Processing of S150 will be described in detail with reference to FIG. 11B. As illustrated in FIG. 11B, the controller 660 executes a step S151 and a step S152A, and then executes steps S112A to 123A, that are already described. In the following, description of the steps S112A to 123A may be simplified.

In S151 of FIG. 11B, the controller 660 sets the plurality of pieces of image data stored in the RAM to the first image data. The first image data is to be recorded in the first recording process. The controller 660 then executes the steps S112A to S121A. If YES in S121A, the controller 660 stops the first process in S152A. After the step S152A, the controller 660 executes the step S123A.

Effects of Embodiment

Figure 10:
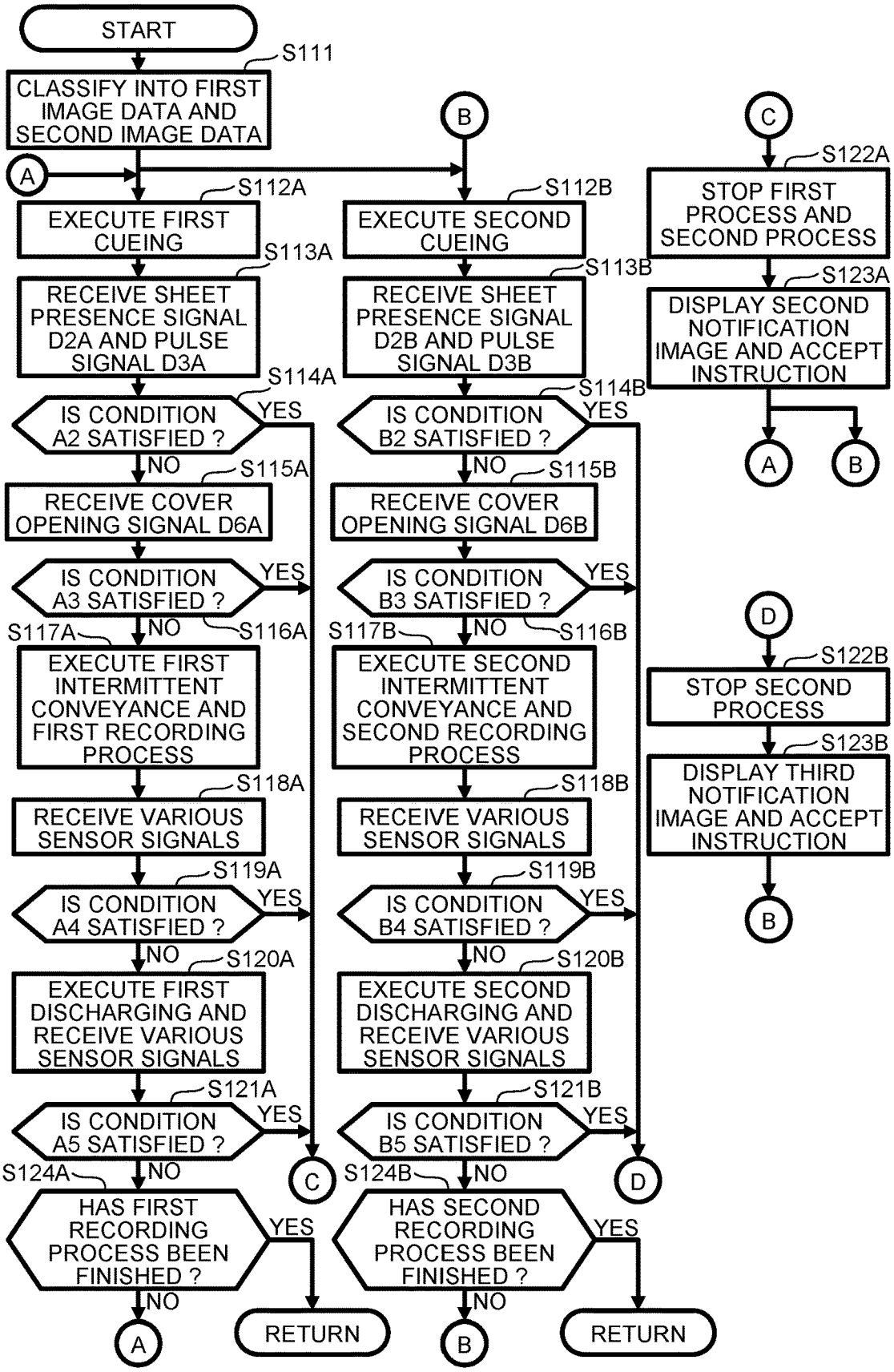
FIG. 10 is a flowchart of detailed processing of a step S110 in FIG. 9.

According to the embodiment, the controller 660 stops the second process if the controller 660 determines, during executing the first process and the second process, that either of the conditions B2, B3, B4 and B5 is satisfied (S114B, S116B, S119B and S121B of FIG. 10). The controller 660 continues the first process even if the controller 660 stops the second process. Thus, the printer 100 may continue processes including the recording process therein.

The controller 660 stops each of the first process and the second process if the controller 660 determines, during executing the first process and the second process, that either of the conditions A2, A3, A4 and A5 is satisfied (S114A, S116A, S119A and S121A of FIG. 10). Thus, the user may open both of the inner path cover 530 and the outer path cover 540 to pick up the jammed sheet 1A from the conveying path 440A.

The printer 100 includes the inner path cover 530 and the outer path cover 540. The user may open the outer path cover 540 while maintaining the position of the inner path cover 530 at its mounting position. Thus, the controller 660 may continue the first process while the user picks up the jammed sheet 1B from the conveying path 440B.

The first printing mechanism includes the supplying tray 410A and the recording head 480A. The second printing mechanism includes the supplying tray 410B and the recording head 480B. The recording head 480B, the recording head 480A, the supplying tray 410A, and the supplying tray 410B are arranged in this order from top to bottom in the casing 200. In other words, the second printing mechanism is located between the first printing mechanism and the bottom of the casing 200. Thus, the printer 100 may have a low profile.

The controller 660 may execute the first process in the step S150 of FIG. 9 in accordance with the plurality of image data while the condition B1 is satisfied, i.e., the second process is not to be executed. Thus, the first process may output the printed sheet 1A even if the second process is not executed.

The controller 660 may receive another recording instruction via the communication interface 690 after the controller 660 determines that either of the conditions A2, A3, A4 and A5 is satisfied, i.e., the first process is not to be executed, as illustrated in FIG. 10. In response to determining that either of these conditions is satisfied, the status information D7A is changed to the first value indicating that the first process is not to be executed, and remains the first value until the controller 660 accepts in the step S123A of FIG. 10 instruction from the user after the user finishes the operations. Under this condition, the controller 660 executes the second process in the step S130 in FIG. 9 according to a further recording instruction. Thus, the printer 100 may continue processes including the recording process therein.

First Modification

Figure 12:
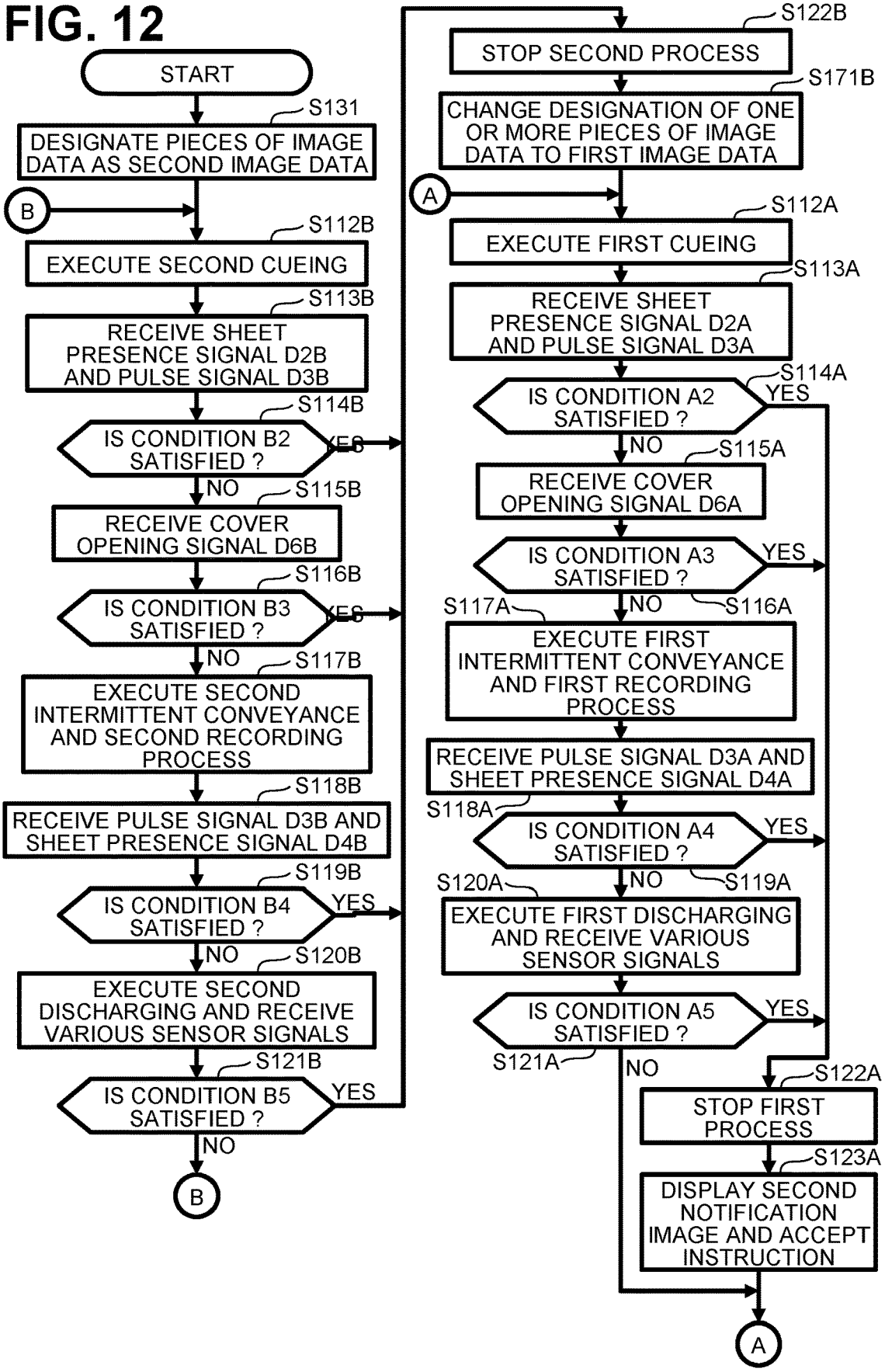
FIG. 12 is a flowchart of detailed processing of the step S130 in FIG. 9 according to a modification.

In the first modification, the controller 660 executes a second process as illustrated in FIG. 12. In FIG. 12, the controller 660 executes a step S171B after the step S122B, and then executes the steps S112A to S123A.

In S122B, the controller 660 stops the second process. In S171B, the controller 660 sets, to the first image data, one or more pieces of second image data that has not been processed in the second process. The controller 660 executes the steps S112A to S123A thereafter.

According to the first modification, the controller 660 starts executing the first process in response to stopping the second process. This enables to continue processes without waiting user's instruction. Thus, the printer 100 may continue processes including the recording process therein without delaying.

Second Modification

In the second modification, in S122A of FIG. 10, the controller 660 may continue the second process until the second process finishes for all of pieces of the second image data, instead of stopping the second process immediately in response to determination that one of the conditions A2 to A5 is satisfied.

Third Modification

Figure 13:
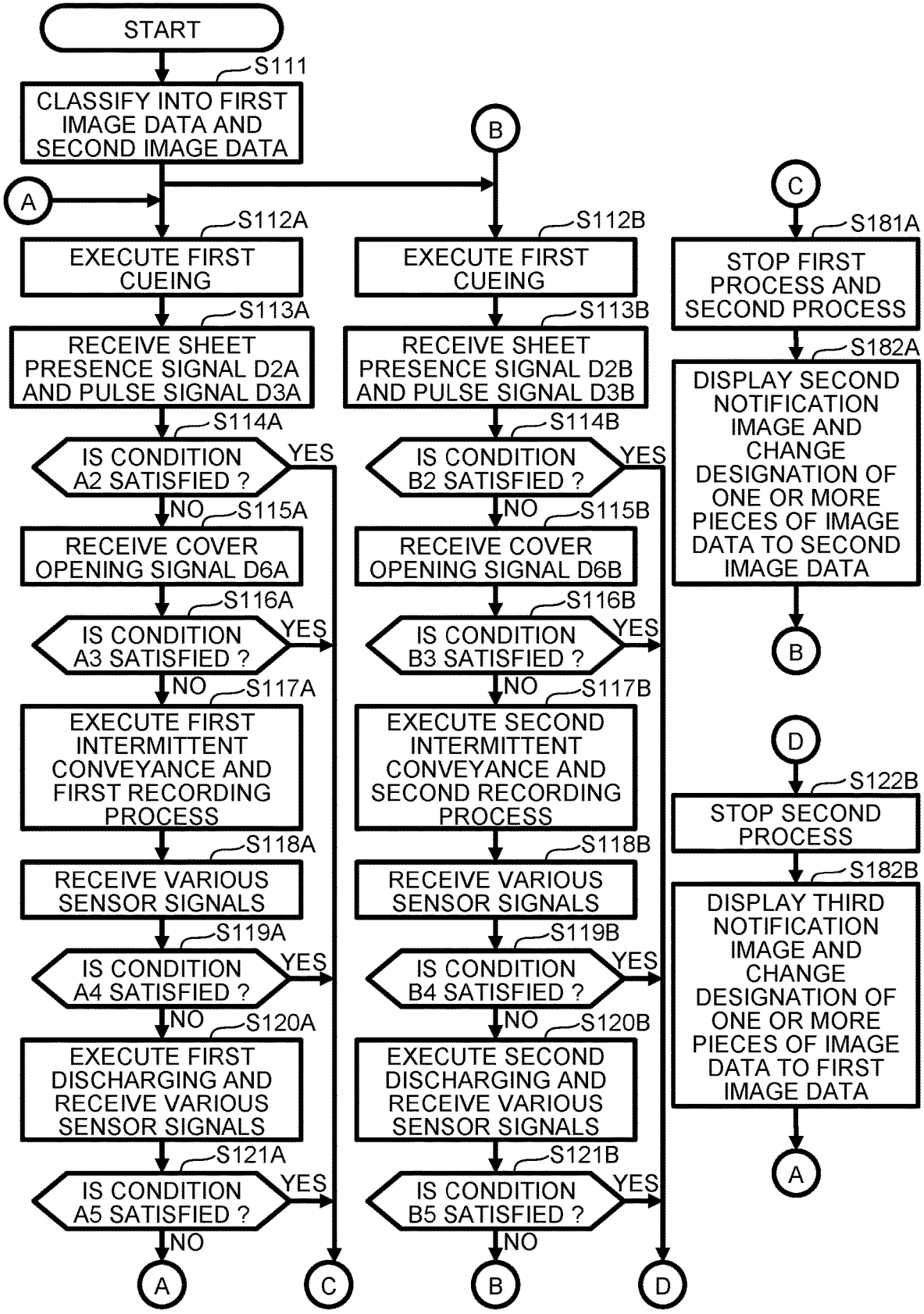
FIG. 13 is a flowchart of detailed processing of the step S110 in FIG. 9 according to a modification.

In the third modification, the controller 660 executes the first process and the second process as described in FIG. 13. The controller 660 executes steps S181A, S182A and S182B instead of the steps S122A, S123A and S123B of FIG. 10.

The controller 660 stops the first process in step S181A. Then, in step S182A, the controller 660 displays the second notification image, and sets, to the second image data, one or more pieces of first image data that has not been processed in the first process. Then, the controller 660 executes the steps S112B to S121B.

After the step S121B, the controller 660 stops the second process in step S122B. After the step S122B, in step S182B, the controller 660 displays the third notification image, and sets, to the first image data, one or more pieces of second image data that has not been processed in the second process. Then, the controller 660 executes the steps S112A to S121A. Thus, the printer 100 may continue processed including the recording process therein.

Another Modification

The image recording apparatus may be, instead of the printer 100, a multifunction device including a printing function.

The external device may be, instead of the information processing apparatus 700 such as a personal computer or a smartphone, a scanner.

The conveying paths 440A and 440B may be, instead of a U-turn path, an S-shaped path or a straight path.

The inner path cover 530 may be pivotable between an opened position and a closed position, instead of being removable from the casing 200. In other words, a part of the inner path cover 530 may be separated from the closed position.

The outer path cover 540 may be detachable from the casing 200, instead of being pivotable between the closed position P2A and the opened position P2B. In other words, the outer path cover 540 may be entirely removed from the casing 200.

The sheet sensors 610A and 610B may be a reflective optical sensor or a weight sensor.

The registration sensors 620A and 620B and the discharging sensors 640A and 640B may be an optical photointerrupter. In this modification, the light emitter and the light receiver in the registration sensor 620A are disposed so as to face each other across the downstream end of the curved portion 441A in an intersecting direction intersecting the curved portion 441A.

The controller 660 may estimate the remaining amount of ink based on printed volume, instead of output from the ink sensors 650A and 650B. A known technique can be applied for obtaining the printed volume.

The first image data may be a plurality of pieces of image data having an odd number in the sequence of printing, instead of the plurality of image data arranged at latter half in the sequence of printing. The second image data may be a plurality of image data having an even number in the sequence of printing, instead of the plurality of image data arranged at former half in the sequence of printing.

The controller 660 may stop only the first process and may not stop the second process in a case where the sheet presence signal D1A is at the low level or the ink presence signal D5A is at the high level, instead of stopping both of the first process and the second process.

What is claimed is:

1. An image forming apparatus comprising:

a casing having a front end and a rear end;

a first tray configured to accommodate a first recording medium;

a first print engine configured to record a first image on the first recording medium;

a second tray configured to accommodate a second recording medium;

a second print engine configured to record a second image on the second recording medium; and a controller configured to perform:

receiving image data, the image data including first image data representing the first image and second image data representing the second image;

executing a first process including a first conveying process and a first recording process, the first conveying process being for conveying the first recording medium from the first tray toward the first print engine along a first path, the first recording process being for recording the first image on the first recording medium by the first print engine;

executing a second process including a second conveying process and a second recording process, the second conveying process being for conveying the second recording medium from the second tray toward the second print engine along a second path, the second recording process being for recording the second image on the second recording medium by the second print engine, the second path being located between the first path and the rear end of the casing;

determining whether an error has occurred in the second process;

in a case where the error has occurred in the second process, stopping the second process while continuing the first process;

determining whether an error has occurred in the first process; and in a case where the error has occurred in the first process, stopping each of the first process and the second process.

2. The image recording apparatus according to claim 1, wherein the error in the first process is a jam of the first recording medium in the first path, and wherein the error in the second process is a jam of the second recording medium in the second path.

3. The image recording apparatus according to claim 1, further comprising:

a first cover movable between a first opened position and a first closed position; and a second cover movable between a second opened position and a second closed position, and located between the first cover and the rear end of the casing, wherein the first cover at the first closed position defines the first path, and wherein the second cover at the second closed position defines the second path.

4. The image recording apparatus according to claim 3, wherein the controller is configured to determine that the error in the first process occurs when detecting the first cover is away from the first closed position, and wherein the controller is configured to determine that the error in the second process occurs when detecting the second cover is away from the second closed position.

5. The image recording apparatus according to claim 1, wherein the second tray and the second print engine are arranged in a height direction, wherein the first tray and the first print engine are arranged in the height direction between the second tray and the second print engine, wherein the first path includes a first curved portion that curves toward the first print engine, and wherein the second path includes a second curved portion that curves toward the second print engine, the second curved portion being located between the rear end of the casing and the first curved portion.

6. The image recording apparatus according to claim 1, wherein the controller is configured to perform, in response to receiving third image data representing a third image in a state where the error has occurred in the second process, executing the first process including the first recording process for recording the third image on the first recording medium by the first print engine.

7. The image recording apparatus according to claim 1, wherein the controller is configured to perform, in response to receiving fourth image data representing a fourth image in a state where the error has occurred in the first process, executing the second process including the second recording process for recording the fourth image on the second recording medium by the second print engine.

8. The image recording apparatus according to claim 1, wherein in a case where the error has occurred in the second process, the controller is configured to perform:

stopping the second process; and continuing the first process such that the first recording process causes the first print engine to record the second image.

9. The image recording apparatus according to claim 1, wherein in a case where an error has occurred in the first process, the controller is configured to perform:

stopping the first process; and continuing the second process such that the second recording process causes the second print engine to record the first image.

10. The image recording apparatus according to claim 1, wherein the first image data is a plurality of pieces of image data arranged at latter half in a sequence of printing, and wherein the second image data is a plurality of pieces of image data arranged at former half in the sequence of printing.

11. An image forming apparatus comprising:

a casing having a front end and a rear end;

a first tray configured to accommodate a first recording medium;

a first print engine configured to record an image on the first recording medium;

a second tray configured to accommodate a second recording medium;

a second print engine configured to record an image on the second recording medium; and a controller configured to perform:

receiving image data;

executing a second process without executing a first process, wherein the first process includes a first conveying process and a first recording process, the first conveying process being for conveying the first recording medium from the first tray toward the first print engine along a first path, the first recording process being for recording the image on the first recording medium, and wherein the second process includes a second conveying process and a second recording process, the second conveying process being for conveying the second recording medium from the second tray toward the second print engine along a second path, the second recording process being for recording the image on the second recording medium, the second path being located between the first path and the rear end of the casing;

determining whether an error has occurred in the second process; and in a case where the error has occurred in the second process:

stopping the second process; and executing the first process such that the first recording process causing the first print engine to record the image on the first recording medium;

determining whether an error has occurred in the first process; and in a case where the error has occurred in the first process, stopping each of the first process and the second process.

* * * * *